US011351799B2

(12) United States Patent
Washio et al.

(10) Patent No.: US 11,351,799 B2
(45) Date of Patent: Jun. 7, 2022

(54) RECORDING DEVICE WITH KNOCKING UNIT FOR KNOCKING MEDIUM DURING RECORDING

(71) Applicant: SEIKO EPSON CORPORATION, Tokyo (JP)

(72) Inventors: Yuichi Washio, Shiojiri (JP); Seijun Horie, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/132,262

(22) Filed: Dec. 23, 2020

(65) Prior Publication Data

US 2021/0197596 A1 Jul. 1, 2021

(30) Foreign Application Priority Data

Dec. 26, 2019 (JP) ..... JP2019-235875

(51) Int. Cl.

*B41J 15/04* (2006.01)
*B41J 15/16* (2006.01)
*B41J 11/00* (2006.01)

(52) U.S. Cl.

CPC ..... *B41J 15/04* (2013.01); *B41J 11/007* (2013.01); *B41J 15/165* (2013.01); *B41J 11/009* (2013.01)

(58) Field of Classification Search

CPC ..... B41J 15/04; B41J 15/165; B41J 11/007; B41J 11/009

See application file for complete search history.

(56) References Cited

U.S. PATENT DOCUMENTS

2017/0197441 A1* 7/2017 Mitsuo ..... B41J 3/4078
2019/0084304 A1 3/2019 Sasaki

FOREIGN PATENT DOCUMENTS

| | | | | |
|---|---|---|---|---|
| EP | 3342595 A | | 7/2018 | |
| EP | 3395581 | * | 10/2018 | ..... B41J 15/04 |
| EP | 3395581 A | | 10/2018 | |
| JP | 2018-104848 A | | 7/2018 | |
| JP | 2018-111275 A | | 7/2018 | |
| JP | 2009-149028 A | | 7/2019 | |
| JP | 2020-073311 A | | 5/2020 | |
| WO | WO17/110301 A | | 6/2017 | |
| WO | WO17/155065 A | | 9/2017 | |

* cited by examiner

*Primary Examiner* — Henok D Legesse
(74) *Attorney, Agent, or Firm* — Workman Nydegger

(57) ABSTRACT

A recording device includes a recording unit configured to perform recording on a first surface of a medium, a holding unit configured to hold a roll body obtained by rolling the medium, a transport unit configured to transport the medium unwound from the roll body, and a knocking unit configured to knock on a second surface of the medium between the holding unit and the recording unit, the second surface being a surface opposite the first surface. The knocking unit knocks on the second surface by moving between a spaced position for being spaced apart from the second surface and a contact position for making contact with the second surface.

8 Claims, 7 Drawing Sheets

RECORDING DEVICE WITH KNOCKING UNIT FOR KNOCKING MEDIUM DURING RECORDING

The present application is based on, and claims priority from JP Application Serial Number 2019-235875, filed Dec. 26, 2019, the disclosure of which is hereby incorporated by reference herein in its entirety.

BACKGROUND

1. Technical Field

The present disclosure relates to a recording device including a transport part that transports a medium such as a fabric and a sheet unwound from a roll body along a transport path, and a recording unit that performs recording on a medium that is being transported.

2. Related Art

JP-A-2018-111275 discloses an inkjet printer as an example of a recording device in which a roll body obtained by rolling a medium is held at an upstream position in a transport path, and the recording device includes a transport part that transports the medium unwound from the roll body by winding the medium around a roll body held at a downstream position in the transport path, and a recording unit that records an image and the like by discharging a liquid such as ink to the medium.

The recording device disclosed in JP-A-2018-111275 includes a housing that houses a recording mechanism for recording on the medium, and a blowing unit that blows air flow to the surface of the medium is provided upstream of the housing in the transport direction of the medium.

In the recording device described in JP-A-2018-111275, however, foreign substances are removed by only the air flow of the blowing unit. Depending on the type of the medium, it may be difficult to remove the foreign substances, and as such the foreign substances may not be sufficiently removed.

SUMMARY

A recording device that solves the above-described problems includes a recording unit configured to perform recording on a first surface of a medium, a holding unit configured to hold a roll body obtained by rolling the medium, a transport part configured to transport the medium unwound from the roll body, and a knocking unit configured to knock on a second surface of the medium between the holding unit and the recording unit, the second surface being a surface opposite the first surface. The knocking unit knocks on the second surface by moving between a spaced position for being spaced apart from the second surface and a contact position for making contact with the second surface.

DESCRIPTION OF EXEMPLARY EMBODIMENTS

First Embodiment

Figure 1:
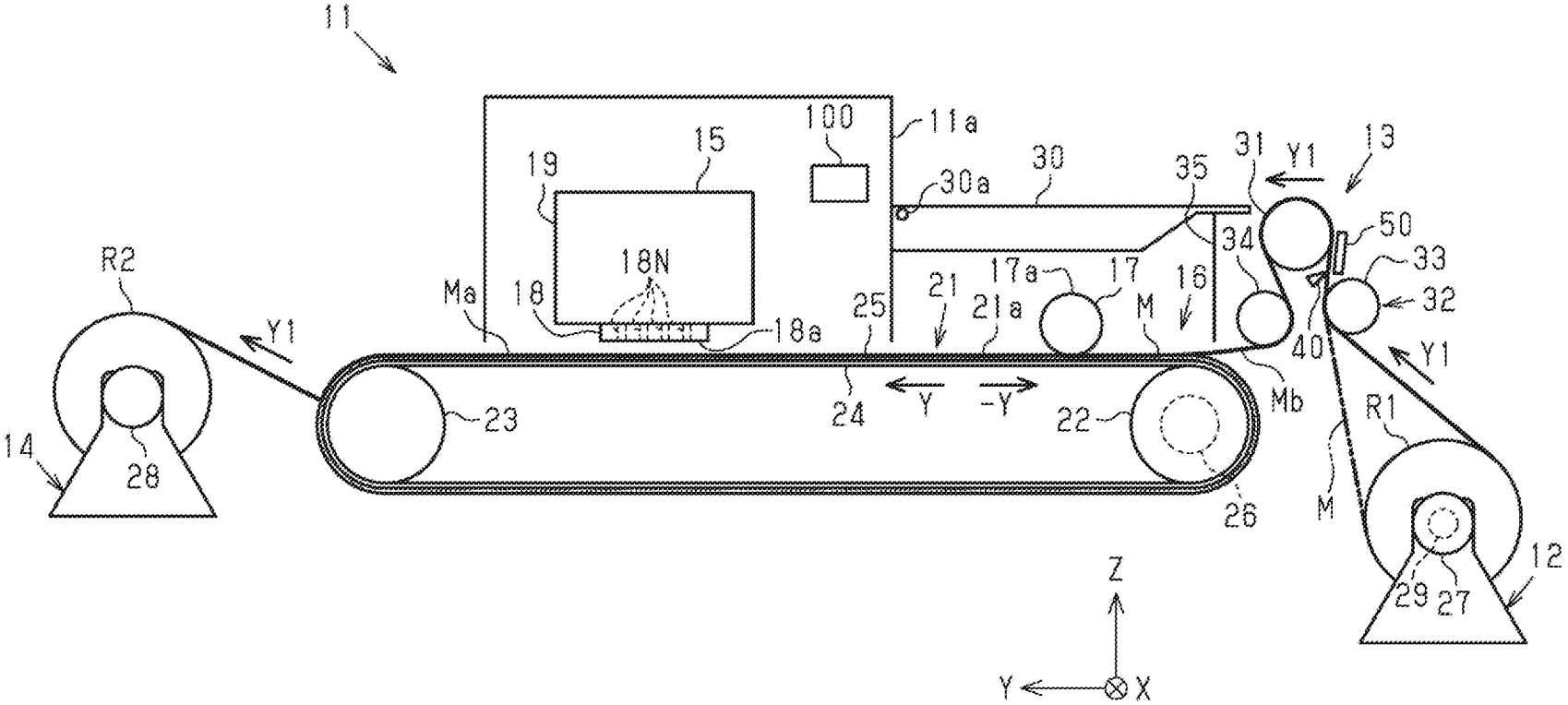
FIG. 1 is a schematic side cross-sectional view of a recording device according to a first embodiment.

Embodiments are described below with reference to the accompanying drawings. In FIG. 1, three virtual axes orthogonal to each other are set as an X axis, a Y axis and a Z axis on the assumption that a recording device 11 is placed on a horizontal surface. The X axis is a virtual axis parallel to the width direction of a transport belt 21 described later, and the Y axis is a virtual axis parallel to a belt transport direction Y in which a medium M on the transport belt 21 is transported. In addition, the Z axis is a virtual axis parallel to the vertical direction. In the following description, a direction along the X axis is also referred to as a width direction X.

As illustrated in FIG. 1, the recording device 11 is, for example, an ink-jet printer that records an image such as characters and photographs by discharging ink, which is an example of a liquid, to the medium M such as a fabric and a sheet. The recording device 11 includes a holding unit 12, a wrinkle suppression device 13, a peeling device 14, a recording unit 15, a transport unit 16 that constitutes an example of a transport part, and a pressing part 17. The holding unit 12 holds a roll body R1 obtained by rolling the medium M. The transport unit 16 transports the medium M unwound from the roll body R1. The recording unit 15 performs recording on a first surface Ma of the medium M. In other words, the first surface Ma of the medium M is a surface on which recording is performed by the recording unit 15. Note that the medium M is transported in a transport direction Y1 along a transport path from the roll body R1 held by the holding unit 12 to a roll body R2 obtained by winding the medium that is peeled from the transport unit 16 by the peeling device 14. The transport direction Y1 is a direction that changes in accordance with the position of the medium M on the transport path. The belt transport direction Y, which is the transport direction of the medium M transported by the transport unit 16, is one of the transport directions Y1. Here, the medium M is movable in the belt transport direction Y and a reverse belt transport direction −Y opposite the belt transport direction Y. The transport direction Y1 is the transport direction for executing a recording operation of the recording unit 15 on the medium M, and the reverse belt transport direction −Y is the transport direction for executing an adjusting operation of adjusting the medium position when setting the medium M to the transport unit 16, for example.

As illustrated in FIG. 1, a housing 11*a* is disposed above the transport unit 16. The recording unit 15 and a control unit 100 are housed in the housing 11*a*. The recording unit 15 performs recording on the medium M by discharging a liquid to the medium M, for example. The recording unit 15 includes a recording head 18 and a head holding unit 19 that holds the recording head 18. The recording head 18 includes a nozzle 18N that discharges droplets and a nozzle surface 18*a* at which the nozzle 18N opens. The nozzle surface 18*a* faces a support surface 21*a* of the transport belt 21 with a predetermined gap therebetween. An image is recorded on the medium M when droplets discharged from the nozzle 18N impinge on the first surface Ma of the medium M that is stuck on the support surface 21*a*.

The recording unit 15 may be a serial head that performs scanning for the medium M, or may be a line head that extends over a range substantially equal to the width of the medium M. In the case where the recording unit 15 is a serial head, the head holding unit 19 is a carriage that moves in a scanning direction parallel to the width direction X, which is the direction along the X axis. A recording to the medium M is performed in such a manner that the recording head 18 discharges droplets from the nozzle 18N while the carriage moves in the scanning direction. In the case where the recording unit 15 is a line head, recording on the medium M is performed in such a manner that droplets are simultaneously discharged from a plurality of the nozzles 18N arranged in a range substantially equal to the width of the medium M toward the medium M transported at a constant speed. Note that in the following description, in the case where the recording device 11 is a serial printer, the carriage that serves as the head holding unit 19 is referred to as "carriage 19".

As illustrated in FIG. 1, the transport unit 16 includes the transport belt 21, a driving roller 22, and a driven roller 23. The transport belt 21 is wound around the driving roller 22 and the driven roller 23. The transport belt 21 includes an endless base member 24 and an adhesive layer 25 provided on the outer circumferential surface of the base member 24. The adhesive layer 25 is formed by applying an adhesive agent to the entirety of the outer circumferential surface of the base member 24. In other words, the transport belt 21 is a glue belt including the adhesive layer 25. The transport belt 21 includes the support surface 21*a* for supporting the medium M on the surface of the adhesive layer 25. The medium M is supported by the support surface 21*a* in the state where the medium M is stuck to the surface of the adhesive layer 25.

The transport unit 16 includes a transport motor 26 as a drive source. The driving roller 22 is connected to the transport motor 26 such that power can be transmitted. As the transport motor 26 is driven, the driving roller 22 rotates. As the driving roller 22 rotates, the transport belt 21 turns round. The driven roller 23 is driven into rotation in accordance with the turn of the transport belt 21. In this manner, the transport motor 26 transfers a driving force to the driving roller 22 to drive the transport belt 21. As the transport belt 21 turns round, the medium M stuck to the support surface 21*a* is transported. Note that the positions of the driving roller 22 and the driven roller 23 may be reversed such that the roller on the downstream side in the belt transport direction Y is the driving roller 22.

As illustrated in FIG. 1, the pressing part 17 is disposed at a position upstream of the recording unit 15 in the belt transport direction Y so as to face the support surface 21*a* of the transport belt 21 from above. The pressing part 17 presses the medium M against the transport belt 21. In this manner, the medium M is stuck to the adhesive layer 25. The pressing part 17 sequentially sticks the medium M to the adhesive layer 25 along with the turn of the transport belt 21.

The pressing part 17 includes a pressing roller 17*a* that makes contact with the first surface Ma of the medium M to apply a pressure to the medium M. The pressing part 17 includes a moving mechanism (not illustrated) that reciprocates the pressing roller 17*a* along the support surface 21*a* of the transport belt 21. In the pressing part 17, the pressing roller 17*a* reciprocates in the belt transport direction Y and the reverse belt transport direction −Y while applying a pressure to the medium M, and thus a second surface Mb of the medium M is securely stuck to the adhesive layer 25. The second surface Mb of the medium M is the surface opposite the first surface Ma of the medium M. Note that the pressing roller 17*a* may reciprocate in the width direction X or may reciprocate in an intersecting direction intersecting both the width direction X and the belt transport direction Y. In addition, the pressing part 17 is not limited to the configuration in which the medium M is pressed against the support surface 21*a* by the pressing roller 17*a*, and may have a configuration in which the medium M is pressed against the support surface 21*a* by an air pressure.

Figure 2:
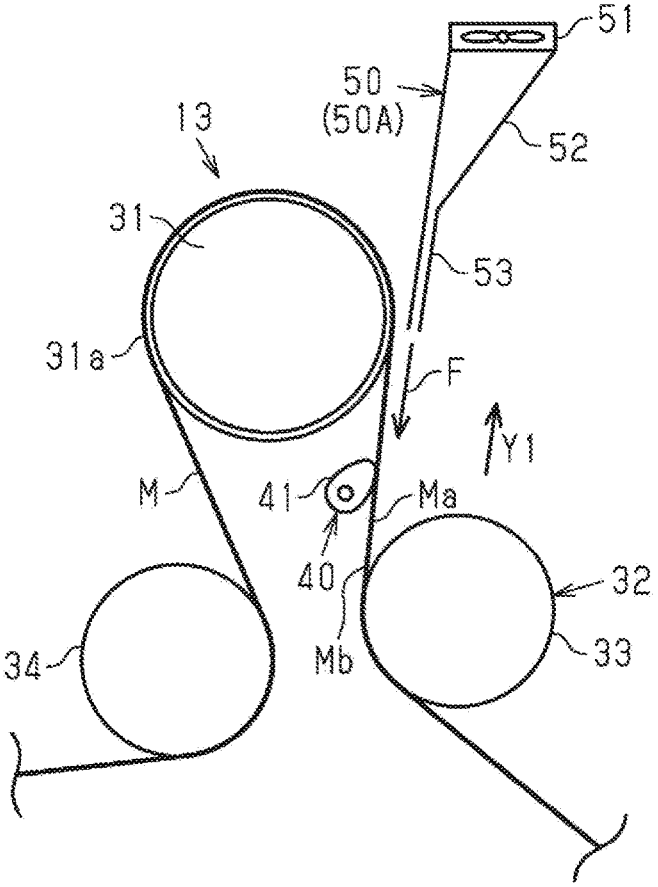
FIG. 2 is a schematic side view illustrating a knocking unit and a blowing unit.

As illustrated in FIG. 1, the recording device 11 includes a cover 30 capable of covering the medium M on the transport belt 21 at a portion upstream of the recording unit 15 in the belt transport direction Y. In this embodiment, the cover 30 covers the transport unit 16 at a portion upstream of the portion covered by the housing 11*a* in the belt transport direction Y. Specifically, the cover 30 covers, from above, the region including the space where the pressing part 17 is disposed. As illustrated in FIG. 2, the cover 30 can be opened and closed by turning about a turning shaft 30*a* provided near the housing 11*a*.

A setting operation of setting the medium M to the pressing part 17 can be performed by moving the cover 30 from the closed position illustrated in FIG. 1 to the open position. In addition, when the cover 30 is in the closed position, the medium M is protected by the cover 30 from foreign substances in the outside air at the vicinity of the portion pressed by the pressing part 17. In addition, the cover 30 has a partition plate 35 as a partition between the wrinkle suppression device 13 and the pressing part 17. Together with the cover 30, the partition plate 35 constitutes a part of the wall that defines the chamber in which the pressing part 17 is housed, and prevents entry of foreign substances into the chamber from the rear of the recording device 11. While FIG. 1 illustrates a side cross-sectional view of a portion of the recording device 11, the lower region of the housing 11*a* and the cover 30 are covered with side walls (not illustrated) on both sides in the width direction X.

As illustrated in FIG. 1, the medium M that is stuck to the support surface 21*a* by the pressing part 17 is transported in the belt transport direction Y as the transport belt 21 turns round. The recording unit 15 performs recording on the medium M on the support surface 21*a* at a recording position in the course of the transport on the transport belt 21.

The holding unit 12 holds the roll body R1 obtained by rolling the medium M. The holding unit 12 rotatably supports the roll body R1. The roll body R1 held by the holding unit 12 is obtained by rolling the medium M before a recording. The roll body R1 is hereafter referred to also as a first roll body R1. In this embodiment, the medium M is unwound from the first roll body R1 held by the holding unit 12 by driving the transport belt 21. The unwound medium M is transported along the transport path from the holding unit 12 to the recording unit 15. In this embodiment, the holding unit 12 is provided with a feeding motor 27 serving as a drive source for feeding the medium M from the roll body R1 held therein. Together with the transport unit 16, the feeding motor 27 constitutes an example of a transport part. Note that the feeding motor 27 may not be provided as long as an excessive tension is not applied to the medium M at the portion between the first roll body R1 and the transport belt 21. Note that, as illustrated in FIG. 1, the method of pulling out the medium M from the first roll body R1 includes a first pulling method in which the outer surface of the first roll body R1 is the recording surface (first surface Ma) as illustrated by the solid line in FIG. 1, and a second pulling method in which the outer surface of the first roll body R1 is the surface opposite the recording surface as illustrated by the chain double-dashed line in FIG. 1.

Figure 4:
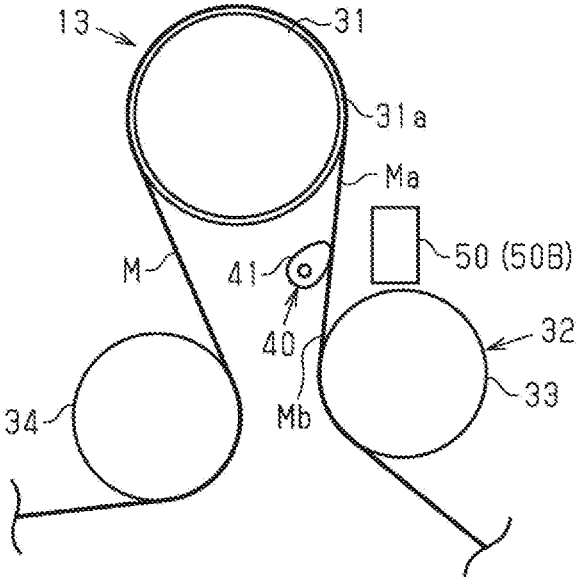
FIG. 4 is a schematic side view illustrating the knocking unit and a suction part.

As illustrated in FIGS. 2 and 4, the wrinkle suppression device 13 includes a tension roller 31 as an example of a tension bar capable of making contact with the second surface Mb of the medium M in a portion between the holding unit 12 and the recording unit 15, and a roller pair 32 capable of winding the medium M around the tension roller 31. One roller of the roller pair 32 pushes the first surface Ma at the portion upstream of the portion wound around the tension roller 31, and the other roller of the roller pair 32 pushes the first surface Ma at the portion downstream of the portion wound around the tension roller 31, and thus, the medium M is wound around the tension roller 31.

The tension roller 31 presses the second surface Mb of the medium M between the holding unit 12 and the recording unit 15 to apply a tension to the medium M. With the roller pair 32, the medium M can be wound halfway or more around the tension roller 31. The roller pair 32 is composed of a pair of a first guide roller 33 and a second guide roller 34 disposed side by side at positions on one side spaced from the tension roller 31. The first guide roller 33 corresponds to one roller of the roller pair 32 and the second guide roller 34 corresponds to the other roller of the roller pair 32. The medium M unwound from the first roll body R1 is wound around a portion of the outer circumferential surface of the tension roller 31 in the state where it is guided by the first guide roller 33 and the second guide roller 34. At this time, by the reaction of the contact of the medium M with the outer circumferential surface of the tension roller 31, the tension roller 31 can press the medium M in the direction away from the guide rollers 33 and 34. In this manner, a tension is applied to the medium M. Note that the tension roller 31 may not be biased in the direction away from the guide rollers 33 and 34, or may be biased in the direction away from the guide rollers 33 and 34 by an elastic member such as a spring.

The outer circumferential surface of the tension roller 31 is a surface having a friction force higher than that of the outer circumferential surfaces of the guide rollers 33 and 34. The user winds the medium M pulled out from the first roll body R1 around the tension roller 31 in a state where the medium M is stretched with no wrinkle. When the medium M is initially set in a stretched state, the medium M is not easily slid at least in the width direction X with the high friction surface, i.e., the outer circumferential surface of the tension roller 31, and thus the state where the medium M is stretched in the width direction X is maintained in the process of winding it around the tension roller 31. In this manner, formation of a wrinkle in the medium M is suppressed. For example, a wrinkle formed in the medium M due to a meander or a skew of the medium M causes a fold when it is pressed by pressing roller 17*a*. The wrinkle suppression device 13 maintains the state where a tension in the width direction X is applied to the medium M in order to prevent such a fold, and thus suppresses an increase of the wrinkles of the medium M at a position downstream of the wrinkle suppression device 13 in the transport direction Y1. Note that instead of the tension roller 31, a non-rotatable tension rod may be adopted as an example of the tension bar. In short, it suffices that a tension can be applied to the medium M.

The peeling device 14 rotatably holds the roll body R2 obtained by rolling the medium M. The roll body R2 held by the peeling device 14 is a roll body of the recorded medium M passed between the recording unit 15 and the transport belt 21. The roll body R2 is hereafter referred to also as a second roll body R2. The peeling device 14 includes a winding motor 28 serving as a drive source for winding the medium M around the holding roll body R2. The peeling device 14 peels the medium M from the transport belt 21 by rotating the second roll body R2 at a predetermined rotational torque with the driving force of the winding motor 28. The peeling device 14 collects the recorded medium M by winding the peeled medium M as the second roll body R2.

Note that a cleaning part and a drying part (not illustrated) are provided below the transport belt 21 in the Z direction. The cleaning part cleans the support surface 21*a* to remove the liquid such as ink and foreign substances such as fuzz adhered to the support surface 21*a*. The cleaning part cleans the support surface 21*a* by, for example, bringing a brush that is wet with cleaning liquid into contact with the support surface 21*a*. The drying part heats and dries the support surface 21*a* that is wet with the cleaning liquid after the cleaning. In the drying part below the transport belt 21, the cleaning part is located upstream in the turning direction of the transport belt 21, and the drying part is located downstream in the turning direction. As the transport belt 21 turns round, the cleaning of the support surface 21*a* and the drying of the support surface 21*a* that is wet with the cleaning liquid are sequentially performed. In addition, the adhesive force of the adhesive layer 25 is increased when heated by the drying part.

A plurality of liquid reservoirs (not illustrated) containing a liquid such as ink are disposed inside the housing 11*a*. The plurality of liquid reservoirs contains respective liquid of different types. For example, the plurality of liquid reservoirs contains respective ink of different colors including black, cyan, magenta, and yellow. The liquid contained in the liquid reservoirs is supplied to the recording unit 15 through a tube (not illustrated). The recording unit 15 discharges the liquid supplied from the liquid reservoirs from the nozzle 18N of the recording head 18. The liquid reservoir is composed of any of an ink tank, an ink cartridge and an ink pack, for example.

The control unit 100 controls the recording device 11. The control unit 100 controls the pressing part 17, the transport motor 26 of the transport unit 16, the recording unit 15, a knocking unit 40, and a removing unit 50.

Figure 3:
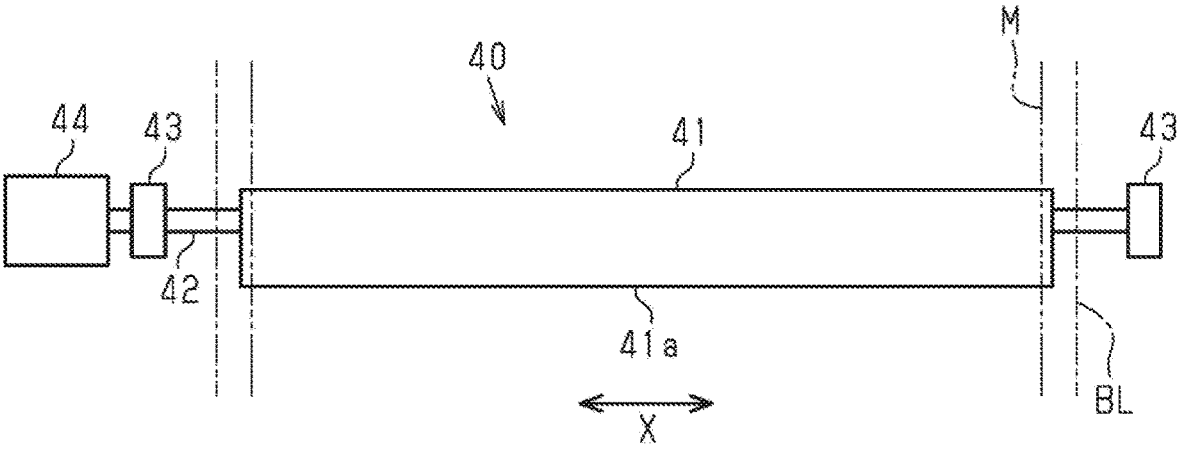
FIG. 3 is a front view illustrating a configuration of the knocking unit.

Next, a configuration of the wrinkle suppression device 13 is described with reference to FIGS. 2 and 3.

As illustrated in FIG. 2, a friction member 31*a* composed of a high friction material is provided on the outer circumferential surface of the tension roller 31 constituting the wrinkle suppression device 13. In other words, the friction member 31*a* is provided at the portion that makes contact with the second surface Mb of the medium M in the tension roller 31. The friction member 31*a* is, for example, a tape stuck to the outer circumferential surface of the tension roller 31, and at least the surface layer thereof is composed of a high friction material. The friction coefficient of the outer circumferential surface of the tension roller 31 is higher than the friction coefficients of the outer circumferential surfaces of the two guide rollers 33 and 34 constituting the roller pair 32.

The three rollers 31, 33 and 34 constituting the wrinkle suppression device 13 are supported such that they are rotatable with respect to a frame (not illustrated) extending rearward of the recording device 11. The axial directions of the three rollers 31, 33 and 34 are parallel to the X axis.

The tension roller 31, which is the main roller of the wrinkle suppression device 13, is a driven roller, and is rotated by the same amount as the transport amount of the medium M by the force of the transport belt 21 pulling the medium M. The two guide rollers 33 and 34 are metal rollers, for example. As such, compared to the tension roller 31, the two guide rollers 33 and 34 cause more slip of the medium M such as a fabric.

In the wrinkle suppression device 13, the tension roller 31 is located at the highest position in the Z-direction, and the roller pair 32 is located below the tension roller 31 in the Z-direction. With respect to the tension roller 31, the first guide roller 33 is located upstream in the transport direction Y1, and the second guide roller 34 is located downstream in the transport direction Y1. The medium M unwound from the first roll body R1 is transported upward via a portion of the outer circumferential surface of the first guide roller 33, and is then wound around the outer circumferential surface of the tension roller 31 in an angle range of 180 degrees (halfway) or more. In the example illustrated in FIG. 2, the distance between the two guide rollers 33 and 34 is smaller than the diameter of the tension roller 31, and the medium M is wound around the outer circumferential surface of the tension roller 31 in an angle range of approximately 200 degrees. The medium M passed through the rollers 31, 33 and 34 of the wrinkle suppression device 13 is transported toward the upper surface of the transport belt 21.

As illustrated in FIGS. 1 and 2, the recording device 11 of this embodiment includes the knocking unit 40 capable of knocking the second surface Mb, which is the surface opposite the first surface Ma of the medium M between the holding unit 12 and the recording unit 15. The knocking unit 40 of the present example is provided at a position where the second surface Mb of the medium M between the holding unit 12 and the transport unit 16 can be knocked.

In addition, the removing unit 50 capable of removing foreign substances from the first surface Ma is provided at a position that is opposite to the knocking unit 40 with the medium M or the transport path of the medium M therebetween. In the example illustrated in FIG. 2, the removing unit 50 is a blowing unit 50A that blows gas to the first surface Ma of the medium M. The blowing unit 50A blows air F as an example of the gas from the nozzle 53 toward the medium M. The blowing unit 50A is provided at a position downstream of the knocking unit 40 in the transport direction Y1 of the medium M. The blowing unit 50A blows the air F upstream in the transport direction Y1. The blowing unit 50A blows the air F to remove the foreign substance such as fuzz that scatters from the first surface Ma due to the vibration of the knock of the knocking unit 40 on the second surface Mb. The foreign substance such as fuzz removed from the medium M by the air flow F from the blowing unit 50A is blown away in a direction opposite the recording head 18.

As illustrated in FIGS. 2 and 4, the knocking unit 40 capable of knocking the medium M at a portion between the tension roller 31 and the roller 33 of the roller pair 32 is provided. The knocking unit 40 knocks a central portion of the portion between the tension roller 31 and the roller 33 of the roller pair 32 in the transport direction Y1. The reason for this is to increase the amplitude of the vibration that is applied to the medium M when it is knocked. In addition, the reason for knocking the second surface Mb of the medium M is as follows. If the first surface Ma of the medium M is knocked, there is a risk that the collision of the knock roughens the recording surface in such as manner as to cause breakage of the fibers present in the first surface Ma, or the like. If the liquid is discharged to the roughened first surface Ma, the recording quality decreases. For this reason, the knocking unit 40 knocks the second surface Mb, which is the surface opposite the first surface Ma serving as the recording surface. Note that, depending on the type of the medium M, a knock on the first surface Ma of the medium M is effective for removing foreign substances of the first surface Ma. In particular, in the case where the medium M does not include fibers that are easily broken by the knock, a foreign substance removal effect can be achieved even when the first surface Ma is knocked. In this embodiment, the recording device 11 is an example of a textile printing machine that performs recording on the medium M such as a fabric, and the second surface Mb is knocked so that even the medium M composed of a long-pile fabric can be handled without damaging the recording surface.

In the example illustrated in FIG. 2, the air flow F from the nozzle 53 of the blowing unit 50A flows rearward along the outer circumferential surface of the first guide roller 33. In this manner, reattachment of the removed foreign substance to the medium M at a portion downstream of the knocked portion in the transport path is avoided. While the medium M flutters to some extent with the air F blown from the blowing unit 50A, the propagation of the influence of the flutter to the downstream side of the tension rollers 31 is suppressed since the tension roller 31 is located downstream thereof.

Configuration of Knocking Part

Next, details of the configuration of the knocking unit 40 are described below with reference to FIG. 3. As illustrated in FIG. 3, the knocking unit 40 includes a cam 41 including a contact portion 41*a* capable of making contact with the second surface Mb, and an electric motor 44 as an example of a driving unit for rotating the cam 41. The cam 41 includes a rotation shaft 42 that is rotatable together with the cam 41. Both end portions of the rotation shaft 42 are rotatably supported by a pair of bearings 43. An output shaft of the electric motor 44 is coupled to one end portion of the rotation shaft 42. Note that it is possible to adopt a configuration in which a speed reducing mechanism is interposed between the electric motor 44 and the rotation shaft 42.

The arrangement length of the cam 41 is equal to or greater than the width of the medium M in the width direction X, which intersects the transport direction Y1 of the medium M and is parallel to the support surface 21*a* that supports the medium M in the transport unit 16. In the case where the recording device 11 can handle the medium M of multiple widths, the arrangement length of the cam 41 is preferably equal to or greater than the width of the medium M having the maximum width. FIG. 3 illustrates a belt width region BL corresponding to the width region of the transport belt 21 to illustrate the arrangement length and the arrangement region of the cam 41. As illustrated in FIG. 3, the belt width region BL is set to a value slightly greater than the width region of the medium M since it is necessary to stick the entire region of the second surface Mb of the medium M to the support surface 21*a* of the transport belt 21. The cam 41 is disposed over a region slightly wider than the width region of the medium M such that the vibration can be applied to the medium M over the entire width. In the present example, the cam 41 is disposed over a range that is wider than the width region of the medium M and is narrower than the belt width region BL since it suffices to apply the vibration to the medium M over the entire width. Note that the cam 41 may be disposed in a region wider than the belt width region BL.

Figure 6:
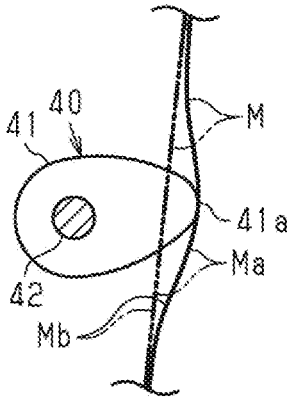
FIG. 6 is a schematic side view illustrating a state where the cam is located at a contact position.

The electric motor 44 is controlled by the control unit 100. The cam 41 rotates when the control unit 100 drives the electric motor 44. When the cam 41 rotates, the contact portion 41*a* knocks the second surface Mb of the medium M as illustrated in FIG. 6. The knocking unit 40 periodically knocks the medium M by the cam 41.

Figure 5:
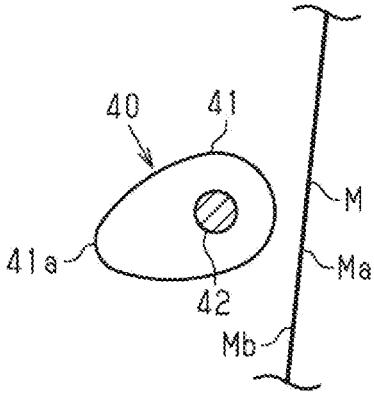
FIG. 5 is a schematic side view illustrating a state where a cam is located at a spaced position.

The knocking unit 40 knocks the second surface Mb by switching between a spaced position illustrated in FIG. 5 for being spaced from the second surface Mb and a contact position illustrated in FIG. 6 for making contact with the second surface Mb. As illustrated in FIG. 5, the cam 41 is an eccentric cam and the distance between the center of rotation of the cam 41 and the contact portion 41*a* is greater than the distance from the center of rotation to a portion other than the contact portion 41*a*. The cam 41 rotates about the rotation shaft 42 located at an eccentric position.

Configuration of Removing Part

Next, details of the configuration of the removing unit 50 are described. The removing unit 50 is the blowing unit 50A illustrated in FIG. 2, but may be composed of a suction part 50B illustrated in FIG. 4. First, a configuration of the blowing unit 50A is described.

As illustrated in FIG. 2, the blowing unit 50A includes a plurality of fans 51 and a duct 52. The fan 51 is disposed at the end portion of the duct 52, for example. The plurality of fans 51 are axial fans, for example. The plurality of fans 51 are disposed side by side in the duct width direction. The number of fans 51 may be set to an appropriate number in accordance with the width of the medium M, the required air volume and air speed, and the like. Note that the number of fans 51 may be one when the required air volume and air speed are achieved.

The duct 52 includes a nozzle 53 at a tip end portion. When the fan 51 is driven, air, which is an example of gas, is blown from the nozzle 53 to the first surface Ma of the medium M. The nozzle 53 is directed toward a portion of the first surface Ma that is opposite to the knocking unit 40 with the transport path of the medium M therebetween at a portion between the first guide roller 33 and the tension roller 31. Alternatively, the nozzle 53 is directed toward an area slightly spaced away from the first surface Ma at a portion that is opposite to the knocking unit 40. The air flow F from the nozzle 53 of the blowing unit 50A is blown toward the above-mentioned area or toward the portion of the first surface Ma that is opposite to the knocking unit 40. In the case where the removing unit 50 is the blowing unit 50A, the movement of foreign substances toward the recording head 18 can be suppressed by directing the air flow in the direction opposite the transport direction Y1 of the medium M.

Next, a configuration of the suction part 50B illustrated in FIG. 4 is described. As illustrated in FIG. 4, the suction part 50B is of a static suction type that suctions charged foreign substances using an electrostatic force, or of a negative pressure suction type that suctions foreign substances by generating suction air flow using a negative pressure. In the case of the electrostatic suction type, the electrostatic force is generated by generating an electric field between the suction part 50B and the first surface Ma of the medium M and/or by generating an electric field between a first electrode (not illustrated) connected to a high voltage side of a power source and a second electrode (not illustrated) connected to a low voltage side of the power source that are disposed side-by-side at a surface opposite the first surface Ma in the suction part 50B. Note that the first electrode and the second electrode are preferably formed in interdigital shapes such that the first electrode and the second electrode are interdigitated with each other. In this manner, the density of the electric field can be increased, and the dust collection performance can be improved. In the case of the negative pressure type, a pressure in the direction from the first surface Ma of the medium M toward the suction part 50B is generated by rotating a fan (not illustrated). The suction part 50B is disposed at a position opposite the knocking unit 40 with the medium M or the transport path of the medium M therebetween. The suction part 50B suctions and removes foreign substances scattered from the first surface Ma in response to a knock of the knocking unit 40 on the second surface Mb of the medium M. Note that the suction part 50B may include a duct box that collects the suctioned foreign substance. As described above, "removal" of foreign substances at the removing unit 50 includes not only removal of foreign substances through a blow of gas flow but also removal of foreign substances through suction.

Advantages of Liquid Discharge Type

In the case where the recording device 11 is of a liquid discharge type (inkjet type) in which the recording unit 15 discharges a liquid, the foreign substances such as dust and fuzz adhered to the surface of the medium M may float due to the jet generated by ejection of the liquid from the nozzle 18N, and the foreign substances may adhere to the nozzle surface 18*a* of the recording head 18. The foreign substances adhered to the nozzle surface 18*a* may cause discharge failure. For example, when a droplet discharged from the nozzle 18N makes contact with foreign substances adhered to a portion in the vicinity of the nozzle 18N, the flight path of the droplet becomes curved. Consequently, the impinging position of the droplet is shifted, and the recording quality is reduced. In addition, foreign substances adhered to the nozzle surface 18*a* cause discharge failure such as dot omission where no droplet is discharged from the nozzle 18N, and clogging of the nozzle 18N. In view of this, in this embodiment, the knocking unit 40 preliminarily removes the foreign substances adhered to the first surface Ma serving as the recording surface of the medium M at a position upstream of the recording unit 15 in the transport direction Y1. In this manner, the amount of the foreign substances that reach a portion in the vicinity of the recording unit 15 together with the medium M can be reduced. As a result, the amount of the foreign substances that float due to the jet generated when the nozzle 18N discharges the liquid can be reduced. Thus, the discharge failure and clogging due to the foreign substances adhered to the nozzle surface 18*a* can be reduced.

Electrical Configuration of Recording Device

Next, an electrical configuration of the recording device 11 is described with reference to FIG. 7.

The recording unit 15, the transport motor 26, the knocking unit 40, and the removing unit 50 are electrically connected to the control unit 100. Specifically, the electric motor 44 of the knocking unit 40, and the fan 51, or an electrostatic suction part or a negative pressure suction part, of the removing unit 50 are connected to the control unit 100. The control unit 100 controls the transport motor 26 such that the transport belt 21 is at a predetermined transport speed. In addition, the control unit 100 can adjust the tension of the medium M from the first roll body R1 held in the holding unit 12 to the transport belt 21 by controlling the output torque of the transport motor 26 such that the tension of the medium M pulled by the driving of the transport belt 21 is not excessive. In this embodiment, the feeding motor 27 and the winding motor 28 are controlled by a control unit (not illustrated) of a device other than the recording device 11. Note that the control unit 100 may be configured to control the feeding motor 27 and the winding motor 28.

In addition, an input part 61 and an operation part 62 are electrically connected to the control unit 100. The input part 61 is a communication interface including an input function capable of inputting various types of data. The control unit 100 inputs print data PD through the input part 61. The print data PD includes medium type information representing the type of the medium M.

The operation part 62 includes an operation switch that is operated by the user to provide various instructions to the recording device 11. The operation part 62 may be an operation panel including a display part. The operation part 62 includes a power switch, a selection switch, and the like. Here, the display part may be composed of a touch panel such that the operation function of the display part serves also as a part of the operation part 62.

In this embodiment, the control unit 100 controls on/off of the knocking unit 40 and the removing unit 50. The control unit 100 may control the on/off of the knocking unit 40 and the removing unit 50 on the basis of an instruction of a user's operation at the operation part 62. Specifically, it is possible to adopt a configuration in which the user can select the on/off of the knocking unit 40 and the removing unit 50 by operating the operation part 62 on a setting screen displayed on the display part of the operation panel, for example. The user selects the on of the knocking unit 40 and the removing unit 50 in the case where the medium M is of a type that requires removal of foreign substances such as dust and fuzz, whereas the user selects the off of the knocking unit 40 and the removing unit 50 in the case where the medium M is of a type that does require removal of foreign substances. Here, in the case where the medium M is a fabric, examples of the medium M of the type that requires removal of foreign substances such as fuzz include cotton and wool. In addition, examples of the medium M that does not require removal of foreign substances such as fuzz include silk and chemical fibers such as nylon.

In addition, the control unit 100 may control the on/off of the knocking unit 40 and the removing unit 50 on the basis of medium type information in the print data PD. In the case where the medium type is a first medium type that requires removal of foreign substances on the basis of the medium type information included in the print data PD, the control unit 100 performs a control to turn on the knocking unit 40 and the removing unit 50. In the case where the medium type is a second medium type that does require removal of foreign substances on the basis of the medium type information included in the print data PD, the control unit 100 performs a control to turn off the knocking unit 40 and the removing unit 50. In this manner, the control unit 100 may perform the on/off control of the knocking unit 40 and the removing unit 50 on the basis of the medium type information. Further, the control unit 100 may perform a selection control of selecting and turning on at least one of the knocking unit 40 and the removing unit 50 on the basis of the medium type information. Specifically, the control unit 100 may switch among four combinations, including three combinations for turning on at least one of the knocking unit 40 and the removing unit 50 and a combination for turning off both of them, in accordance with the medium type.

Note that in the case where the removing unit 50 is the blowing unit 50A or the suction part 50B of the negative pressure type, the control unit 100 may change the rotational speed of the fan 51 (fan) in accordance with the medium type. For example, the speed of rotation of the fan 51 is increased in the case where the medium M is of a type in which foreign substances is difficult to remove from the first surface Ma, such as a carpet, whereas the speed of rotation of the fan 51 is reduced in the case where the medium M is of a type whose posture easily changes, such as a thin and light-weight cloth. In this manner, the removal capacity for foreign substances can be adjusted in accordance with the property of the medium type.

In addition, in the case where the removing unit 50 is the suction part 50B of the electrostatic suction type, the control unit 100 may change the magnitude of the electric field between the suction part 50B and the first surface Ma of the medium M in accordance with the medium type, or may change the magnitude of the voltage (electric field) between the first electrode (not illustrated) and the second electrode (not illustrated).

In addition, the control unit 100 may acquire medium type information about the type of the medium M to change at least one of the knocking frequency and the knocking strength of the knock of the knocking unit 40 on the medium M in accordance with the medium type identified based on the medium type information. In this embodiment, the control unit 100 controls at least one of the knocking frequency and the knocking strength by acquiring the medium type information and changing the rotational speed of the cam 41 in accordance with the medium type identified based on the medium type information.

In the case where the medium M is a fabric, examples of the medium type include cotton, wool, nylon, and silk. In the case where the medium M is a fabric, the material of the fiber of the fabric determines the medium type. In general, in the case where the medium M is cotton and wool, the amount of fuzz is large. Such a medium type with a large amount of fuzz is set as a first medium type. In the case where the type is the first medium type, the control unit 100 controls the rotational speed of the cam 41 at a high speed to increase the knocking frequency. Here, the knocking frequency is the number of times the contact portion 41*a* makes contact with the second surface Mb of the medium M per unit time. In addition, when the rotational speed of the cam 41 is changed, the knocking strength of the knock of the cam 41 on the medium M changes. Here, the knocking strength is a strength of the knock of the contact portion 41*a* on the second surface Mb of the medium M. When the rotational speed of the cam 41 increases, the speed component in the direction orthogonal to the second surface Mb of the medium M in a non-vibrated state increases in the course of the movement of the contact portion 41*a* along the track on the circumference of a circle, and the collision speed in the collision of the contact portion 41*a* with the medium M increases. A high collision speed of the contact portion 41*a* is worth a strong knock on the medium M. The higher the rotational speed of the cam 41, the greater the knocking strength. The lower the rotational speed of the cam 41, the smaller the knocking strength. In the case where the type is the first medium type, the control unit 100 controls the rotational speed of the cam 41 at a high speed to increase the knocking strength.

In addition, in the case where the medium M is nylon and silk, the amount of fuzz is small. Such a medium type with a small amount of fuzz is set as a second medium type. In the case where the type is the second medium type, the control unit 100 controls the rotational speed of the cam 41 at a low speed to reduce the knocking frequency. In addition, in the case where the type is the second medium type, the control unit 100 may control the rotational speed of the cam 41 at a low speed to perform a control of reducing the knocking strength. In addition, in the case where the type is the second medium type, the control unit 100 may not rotate the cam 41 to stop the knock.

Further, a thin medium or a medium type whose material has a low strength is easily torn when repeatedly receiving the impact of the knock, or when receiving a strong impact even with a single knock. Such a medium type that is easily torn is set as the second medium type. In the case where the type is the second medium type, the control unit 100 controls the rotational speed of the cam 41 at a low speed to reduce the knocking frequency. In this manner, the knocking frequency of the knock of the cam 41 on the second surface Mb of the medium M is reduced and tearing of the medium M of the second medium type is prevented. In addition, in the case where the type is the second medium type, the control unit 100 controls the rotational speed of the cam 41 at a low speed to reduce the knocking strength. In this manner, the knocking strength of the knock of the cam 41 on the second surface Mb of the medium M is reduced and tearing of the medium M of the second medium type is prevented. In addition, a thick medium or a medium type whose material has a high strength is less torn even when repeatedly receiving the impact of the knock or when receiving a strong impact of the knock. Such a medium type that is less torn is set as the first medium type. In the case where the type is the first medium type, the control unit 100 controls the rotational speed of the cam 41 at a high speed to increase the knocking frequency. In this manner, the knocking frequency of the knock of the cam 41 on the second surface Mb of the medium M is increased and the foreign substance removal effect for the medium M of the first medium type is increased. In addition, in the case where the type is the first medium type, the control unit 100 controls the rotational speed of the cam 41 at a high speed to increase the knocking strength. In this manner, the knocking strength of the knock of the cam 41 on the second surface Mb of the medium M is increased, and the foreign substance removal effect for the medium M of the first medium type is increased.

In this manner, in the case where the medium M is a fabric, the control unit 100 controls the rotational speed of the cam 41 in accordance with the medium type defined based on the fiber type. In addition, in the case where the medium M is of a medium type other than a fabric such as paper, the control unit 100 controls the rotational speed of the cam 41 in accordance with the medium type defined based on the thickness and material of the medium M. In the case where the type is the second medium type, the control unit 100 causes the cam 41 to knock the medium M at a second knocking frequency lower than a first knocking frequency used for the first medium type. In addition, in the case where the type is the second medium type, the control unit 100 causes the cam 41 to knock the medium M with a second knocking strength smaller than a first knocking strength used for the first medium type.

In addition, the control unit 100 can independently control the knocking frequency and the knocking strength. The period in which the cam 41 is rotated by a unit rotation angle, which is the rotation angle of a single knock, is set as a unit period. In a knock period, which is a period in which the cam 41 knocks the medium M in the unit period, the control unit 100 controls the electric motor 44 at a rotational speed according to the knocking strength corresponding to the medium type, whereas in a non-knock period, which is a period from a completion of a knock to a start of the next knock, the control unit 100 controls the electric motor 44 at a rotational speed according to the knocking frequency corresponding to the medium type. In other words, the control unit 100 adjusts the knocking frequency by controlling the rotational speed of the cam 41 in the non-knock period and adjusts the knocking strength by controlling the rotational speed of the cam 41 in the knock period. Note that the knock may be performed continuously or intermittently during a recording.

In the case where the knock is intermittently performed, the control unit 100 causes the cam 41 to intermittently rotate by driving the electric motor 44 each time the period for performing the knock comes. Examples of a knock actuation period for performing the knock include a period during the scanning of the carriage 19 and a transport period during which intermittent transport of the medium M is performed. The control unit 100 drives the electric motor 44 once each time the knock actuation period comes. Here, the number of knocks is determined by the amount of rotation per driving of the electric motor 44. For example, the number of knocks is increased when the amount of rotation of the cam 41 per driving is increased, whereas the number of knocks is reduced when the amount of rotation of the cam 41 per driving is reduced. The number of knocks is different from the knocking frequency. The number of knocks is determined by the amount of rotation of the cam 41, whereas the knocking frequency is determined by the rotational speed of the cam 41. When the rotational speed of the cam 41 is constant, the knock actuation time from the start of a knock to the end of the knock changes in accordance with the number of knocks. In contrast, in the knocking frequency, the time interval from a knock to the next knock changes.

In addition, the knocking strength is increased when the rotational speed of the cam 41 per driving is increased, whereas the knocking strength is reduced when the rotational speed of the cam 41 per driving is reduced. Accordingly, the control unit 100 can independently control the knocking strength and the number of knocks in accordance with the medium type by selecting the rotational speed and the amount of rotation per driving of the electric motor 44 in accordance with the medium type. For example, only the knocking strength may be changed without changing the number of knocks per driving. In addition, the number of knocks per driving may be changed without changing the knocking strength. Further, the number of knocks may be increased when the knocking strength is increased and the number of knocks may be reduced when the knocking strength is reduced.

In addition, the control unit 100 may control the knocking frequency and the number of knocks in accordance with the medium type by selecting the rotational speed and the amount of rotation per driving of the electric motor 44 in accordance with the medium type. When the knocking frequency is constant, the knock actuation time from the start of a knock to the end of the knock changes in accordance with the number of knocks. For example, a rotation detector such as a rotary encoder that detects the rotation of the cam 41 is provided, and the control unit 100 stops the driving of the electric motor 44 when the amount of rotation of the cam 41 detected by the rotation detector reaches a value corresponding to the number of knocks. In addition, the amount of rotation of the cam 41 is represented by the product of the rotational speed and the rotational time of the cam 41. For this reason, the control unit 100 may control the knocking frequency and the number of knocks by selecting the rotational speed and the rotational time per driving of the electric motor 44 in accordance with the medium type. In addition, in the case where the cam 41 is driven each time the knock actuation period comes, the control unit 100 may control only the knocking frequency in accordance with the medium type, or control only the knocking strength in accordance with the medium type, or, control only the number of knocks in accordance with the medium type. In this manner, the control unit 100 may independently control at least one of the knocking frequency, the knocking strength, and the number of knocks in accordance with the medium type by controlling at least one of the rotational speed of the electric motor 44, the rotational speeds in the knock period and the non-knock period in the unit period, and the amount of rotation per driving in accordance with the medium type.

The control unit 100 performs various controls including the recording control for the recording device 11. The control unit 100 is not limited to a configuration in which it executes all processes through software processes. For example, the control unit 100 may include dedicated hardware (e.g., an application-specific integrated circuit (ASIC)) that executes at least a part of the process executed by it. Specifically, the control unit 100 may be configured as a circuit (circuitry) including one or more processors that operate in accordance with a computer program (software), one or more dedicated hardware circuits that execute at least a part of various processes, or a combination thereof. The processor includes one or more CPUs and one or more memories such as a RAM and a ROM, and the memory stores a program code or a command configured to cause the CPU to execute the process. The memory, i.e., a computer readable medium, includes various mediums that are accessible from general purpose or dedicated computers.

Next, an operational effect of the recording device 11 is described.

After setting the medium M, the user operates the operation part 62 to provide a recording start instruction to the recording device 11. The control unit 100 controls the recording device 11 on the basis of the instructed print data PD. As a result, the recording device 11 starts a running for recording an image based on the print data PD to the medium M.

As the transport belt 21 is rotated, the medium M is transported. At this time, since the medium M is wound around the rollers 31, 33 and 34 of the wrinkle suppression device 13, the medium M is pulled by the transport force of the transport belt 21, and the rollers 31, 33 and 34 are rotated by the pulling force.

The feeding motor 27 is driven in synchronization with the transport motor 26, and the output torque of the transport motor 26 that is the drive source of the transport belt 21 is controlled by the control unit 100, thereby the tension of the medium M from the first roll body R1 held in the holding unit 12 to the transport belt 21 is adjusted to an appropriate value such that the tension is not excessive and that no looseness is formed.

Foreign substances scatter from the first surface Ma of the medium M unwound from the first roll body R1 held by the holding unit 12 when the knocking unit 40 knocks the second surface Mb at a portion between the roller 33 and the tension roller 31. The foreign substances scattered from the first surface Ma are removed by the removing unit 50.

The nozzles 53 of the blowing unit 50A blows air flow upstream in the transport direction Y1 toward the first surface Ma. Foreign substances such as fuzz adhered to the first surface Ma serving as the recording surface of the medium M are removed in advance by the blown air flow F before the recording. In addition, in the case where the removing unit 50 is the suction part 50B, the foreign substances that scatter from the first surface Ma are suctioned into the suction part 50B and are thus removed. As a result, the medium M in which the foreign substance is removed from the first surface Ma is supplied to the transport unit 16. In addition, since the knocking unit 40 knocks the second surface Mb of the medium M, the first surface Ma of the medium M supplied to the transport unit 16 is not a roughened surface with broken fibers or the like.

A tension is applied by the tension roller 31 of the wrinkle suppression device 13. When a tension is applied to medium M, wrinkles of the medium M are removed. The medium M whose wrinkles are removed is supplied to the transport belt 21.

The pressing part 17 presses the medium M onto the transport belt 21 in a pressing region on the upper surface of the transport belt 21. At this time, the medium M is pressed against the adhesive layer 25 by the pressing roller 17*a* reciprocating in the belt transport direction Y, and is stuck to the support surface 21*a* of the transport belt 21. At a recording position, the recording unit 15 performs recording on the medium M stuck to the upper surface of the transport belt 21. The peeling device 14 peels, from the transport belt 21, the recorded medium M stuck to the upper surface of the transport belt 21. In this manner, as the transport belt 21 turns round, cleaning of the medium M, sticking of the medium M, recording on the medium M, and peeling of the recorded medium M are sequentially performed.

For example, in a configuration in which air flow is blown to the medium M from the nozzle 53, the medium M is fluttered by the air flow at the portion between the rollers where the medium M is not supported on the outer circumferential surface of the roller. However, since the tension roller 31 is located downstream of the knocked portion, the sway of the flutter of the medium M is less likely to propagate downstream of the tension roller 31 in the transport direction Y1. For example, when the medium M is slightly swayed or shifted in position in the course of the sticking of the medium M to the support surface 21*a* of the transport belt 21, the medium M can possibly be stuck to the support surface 21*a* while keeping the swayed position or the shifted position. In this case, wrinkles or a shift in the sticking position of the medium M to the transport belt 21 may occur. The wrinkles formed in the medium M become folds when pressed by the pressing roller 17*a*. The shift in the sticking position of the medium M and the fold caused by the shift cause a failure of shifted recording position of images.

In view of this, in this embodiment, a blowing portion to which air flow is blown from the nozzle 53 of the blowing unit 50A is located upstream of the tension roller 31 in the transport direction Y1, and thus, even when the medium M to which the air flow is blown flutters, the propagation of the influence of the flutter to the downstream side of the tension rollers 31 is suppressed. As a result, a high accuracy of the sticking position of the medium M to the transport belt 21 is maintained and there is no risk of inducing wrinkles, and therefore, no fold is formed in the medium M when it is pressed by the pressing roller 17*a*.

Since the medium M is stuck to the support surface 21*a* of the transport belt 21 with high positional accuracy, the accuracy of the impinging position of the droplet discharged from the nozzles 18N of the recording unit 15 is high, and a high-quality image can be recorded to the medium M.

The arrangement length of the cam 41 is longer than the width of the medium M, and thus the cam 41 knocks the medium M over the entire range in the width direction. Therefore, foreign substances adhered to the first surface Ma of the medium M can be effectively removed with no nonuniformity in the width direction X. In this manner, the amount of the foreign substances that float from the first surface Ma of the medium M due to the jet generated when the recording head 18 discharges droplets from the nozzle 18N is very small, and the frequency of occurrence of the discharge failure due to the foreign substances adhered to the nozzle surface 18*a* is reduced. Thus, the reduction in the recording quality due to the foreign substances remaining on the first surface Ma serving as the recording surface of the medium M can be suppressed.

The knocking unit 40 of this embodiment is configured to rotate the cam 41 to mechanically perform the knock, and thus can apply a relatively large vibration to the medium M. Specifically, since the distance from the rotation shaft 42 to the contact portion 41*a* can be freely designed at the time of manufacture of the cam 41, a structure capable of applying a relatively large vibration to the medium M can be achieved. For example, in the case of a configuration in which a vibration is applied using a vibration motor, the vibration is transmitted by bringing the medium M into contact with the vibrator, and as such the amplitude of the vibration that can be applied is very small, and, depending on the type of the medium M, the effect of removing the adhered foreign substance such as fuzz is small. In comparison with the configuration in which the vibration is applied to the medium M using a vibration motor or the like, the knocking unit 40 of this embodiment can apply a vibration of a larger amplitude to the medium M and can achieve a high foreign substance removal effect.

In this embodiment, the tension roller 31 around which the medium M is wound in an intimate contact manner is located downstream of the knocking portion in the transport direction Y1, and the propagation of the vibration to the downstream side thereof is suppressed. Thus, the medium M can be knocked at any time during a recording. In the case where the recording device 11 is of a serial recording type, the medium M can be knocked even during the scanning period or the transport period. In particular, in this embodiment, since the medium M is not easily slip with the high friction surface of the tension roller 31, a knock on the medium M has a less influence on the accuracy of the transport position of the medium M, and a less influence on the shift in the recording position during the scanning. Thus, the medium M can be knocked during the scanning period and the transport period. Note that since the tension is controlled in consideration of the transport load of the medium M in the transport control, the influence of the knock is smaller during the scanning period than during the transport period.

In the case of a configuration in which the knock is made multiple times per scanning, the same location in the medium M can be repeatedly knocked with a configuration in which the medium M is knocked during the scanning period, for example. In this case, a high foreign substance removal effect can be achieved in the area around the knocking portion. In contrast, in the case of a configuration in which the medium M is knocked during the transport period, the medium M can be knocked at different portions in the transport direction Y1, and thus the medium M can be knocked at a plurality of portions with small distances therebetween in the transport direction Y1. Thus, in the transport direction Y1, increase in the number of portions where the cleaning of the medium M is insufficient can be suppressed. Accordingly, the frequency of occurrence of the discharge failure of the recording head 18 due to insufficient cleaning can be reduced.

In addition, the control unit 100 performs a control of changing the knocking frequency or the knocking strength of the knock of the knocking unit 40 on the medium M in accordance with the medium type identified based on the acquired medium type information. Specifically, the control unit 100 changes the rotational speed of the cam 41 in accordance with the medium type identified based on the medium type information.

In the case where the medium type is the first medium type with a large amount of fuzz such as cotton and wool, the control unit 100 controls the rotational speed of the cam 41 at a high speed to increase the knocking frequency or the knocking strength, for example. In addition, in the case where the medium type is the second medium type with a small amount of fuzz such as nylon and silk, the rotational speed of the cam 41 is controlled to a low speed to reduce the knocking frequency or the knocking strength. In addition, in the case where the type is the second medium type, the control unit 100 may not rotate the cam 41 to stop the knock. Further, in the case of the second medium type such as a thin medium or a medium type whose material has a low strength, the control unit 100 reduces the rotational speed of the cam 41. Thus, tearing of the medium M can be suppressed. In addition, in the case of the first medium type such as a thick medium or a medium type whose material has a high strength, the control unit 100 increases the rotational speed of the cam 41. Thus, the foreign substance removal effect for removing foreign substances from the medium M is increased. In addition, in the case where the knocking operation is intermittently performed by driving the electric motor 44 once each time the knock actuation period comes, the control unit 100 may also change at least one of the knocking frequency, the knocking strength, and the number of knocks per driving in accordance with the medium type. In the case where the medium M is of the first medium type, the control unit 100 sets a higher knocking frequency, a larger knocking strength and a larger number of knocks than in the case of the second medium type. At this time, one or two of the knocking frequency, the knocking strength, and the number of knocks may be changed.

Note that the transport path between the first roll body R1 and the first guide roller 33 serving as the first roller differs between the path of the first pulling type illustrated by the solid line in FIG. 1, and the path of the second pulling type illustrated by the chain double-dashed line in FIG. 1. As such, in the case where the configuration in which the knocking unit 40 is disposed at a position where the second surface Mb of the medium M can be knocked at a portion between the first roll body R1 and the first guide roller 33 is adopted, it is necessary to change the position of the knocking unit 40 each time the pulling type for the roll body R1 is changed. At this time, it is necessary to provide an adjustment mechanism that adjusts the position of the knocking unit 40 and the removing unit 50, and the adjustment operation using the adjustment mechanism is a burden on the user. In addition, as the medium M is unwound, the diameter of the roll body R1 changes. When the diameter of the roll body R1 changes, the transport path between the roll body R1 and the first roller accordingly changes. As such, it is necessary to perform an adjustment operation of adjusting the adjustment mechanism in accordance with the change in the diameter of the roll body R1. For example, the medium M may not be properly knocked and insufficient cleaning of the medium M may result unless the adjustment operation is performed at appropriate adjustment timing and at an appropriate adjustment position.

In view of this, the knocking unit 40 of this embodiment knocks the second surface Mb of the medium M at a position between adjacent two rollers including the first roller and rollers located downstream of it in the transport direction Y1 on the transport path. In other words, the knocking unit 40 of this embodiment knocks at least one of the second surface Mb of the medium M in the transport path from the tension roller 31 to the first guide roller 33 and the second surface Mb of the medium M in the transport path from the tension roller 31 to the second guide roller 34. Since these transport paths do not change even when the diameter of the roll body R1 changes, installation of the above-mentioned adjustment mechanism and the adjustment of the same are unnecessary. Thus, the configuration of the cleaning mechanism that removes foreign substances from the first surface Ma of the medium M is simplified, and insufficient cleaning due to a situation in which the medium M cannot be appropriately knocked can be avoided.

According to the above-described embodiment, the following effects are achieved.

(1) The recording device 11 includes the knocking unit 40 capable of knocking the second surface Mb, which is a surface opposite the first surface Ma of the medium M, between the holding unit 12 and the recording unit 15. The knocking unit 40 knocks the second surface Mb by moving between a spaced position for being spaced apart from the second surface Mb and a contact position for making contact with the second surface Mb. Thus, foreign substances attached to the knocking unit 40 scatter from the first surface Ma of the medium M due to the vibration generated by the impact of the knock of the knocking unit 40 on the second surface Mb of the medium M. In this manner, foreign substances can be removed from the medium M. Thus, a foreign substance removal effect higher than using only air blow can be achieved. In addition, when the first surface Ma serving as the recording surface is knocked, the recording surface of the medium M may be damaged. For example, in the case where the medium M is a fabric, the recording surface may be damaged by cutting the fiber, and additional foreign substances such as a fuzz may be increased. In view of this, in this configuration, since the second surface Mb opposite the first surface Ma serving as the recording surface is knocked, there is no risk of damaging the recording surface with increased additional foreign substances such as fuzz on the recording surface, or the like. Thus, a high foreign substance removal effect for removing foreign substances from the medium M can be achieved, and damages to the recording surface of the medium M can be suppressed.

(2) The removing unit 50 capable of removing foreign substances from the first surface Ma is provided at a position that is opposite to the knocking unit 40 with the path of the medium M therebetween. Thus, the foreign substances that scatter from the medium M knocked by the knocking unit 40 can be removed by the removing unit 50. Thus, the reattachment of the foreign substances to the medium M can be suppressed.

(3) The removing unit 50 is the blowing unit 50A that blows gas to the first surface Ma of the medium M, and is provided at a position downstream of the knocking unit 40 in the transport direction Y1 of the medium M. Thus, the foreign substances that scatter from the medium M knocked by the knocking unit 40 can be removed by the gas flow blown from the blowing unit 50A. Thus, the reattachment of the foreign substances to the medium M can be suppressed. In addition, the gas flow is blown upstream from a position downstream of the knocking unit 40 in the transport direction Y1 of the medium M. Thus, the foreign substances can be prevented from flowing to the recording unit 15 located downstream in the transport direction Y1.

(4) The knocking unit 40 is provided so as to be able to knock the medium M at a portion between the tension roller 31 and one roller of the roller pair 32. Thus, the medium M is knocked at a portion to which a tension is applied between the tension roller 31 and one roller of the roller pair 32. In addition, since the path of the medium M at the portion between the tension roller 31 and one roller of the roller pair 32 does not change due to the change in the diameter of the roll body R1, a situation in which the knocking unit 40 cannot knock the second surface Mb due to the change in the path of the medium M can be avoided. Thus, since the second surface Mb of the medium M can be appropriately knocked and the medium M can be appropriately vibrated, a high foreign substance removal effect can be obtained.

(5) The knocking unit 40 includes the cam 41 including a contact portion capable of making contact with the second surface Mb and the electric motor 44 that rotates the cam 41. Thus, the knocking unit 40 with a simple configuration can be achieved.

(6) In the width direction X of the medium M, the arrangement length of the cam 41 is equal to or greater than the width of the medium M. Thus, since the cam 41 can knock the medium M over the range of the entire width, the nonuniformity in the foreign substance removal effect in the width direction X of the medium M can be reduced. In other words, a high foreign substance removal effect is achieved over the entire range of the medium M in the width direction X.

(7) The control unit 100 acquires the medium type information and changes the rotational speed of the cam 41 in accordance with the type of the medium M identified based on the medium type information. Thus, since the rotational speed of the cam 41 is changed in accordance with the type of the medium M, the foreign substance scattering capability can be optimized in accordance with the type of the medium M. For example, the rotational speed of the cam 41 is increased in the case where the medium M is less torn and foreign substances are difficult to remove, whereas the rotational speed is reduced in the case of the medium M that is easily torn. Here, examples of the medium M whose foreign substances are less scatter include a fabric (textile), a knitted fabric and a nonwoven fabric that are long-pile and tend to contain foreign substances therein.

Second Embodiment

Next, a second embodiment is described. The second embodiment has a configuration provided with a vibration application mechanism that vibrates the medium M in a manner different from the knocking unit 40 of the first embodiment. The configuration is the same as that of the first embodiment except that the vibration application mechanism differs from that of the first embodiment. Therefore, the same components are denoted with the same reference signs, and descriptions thereof are omitted.

As illustrated in FIG. 1, the recording device 11 includes the recording unit 15 capable of performing recording on the first surface Ma of the medium M, the holding unit 12 capable of holding the roll body R1 obtained by rolling the medium M, and the transport unit 16 that constitutes an example of the transport part capable of transporting the medium M unwound from the roll body R1.

The recording device 11 includes the feeding motor 27 as an example of a drive source that rotates the roll body R1 supported by the holding unit 12 in forward and reverse directions. The control unit 100 controls the electric motor 44 and the feeding motor 27. In addition, an encoder 29 (see also FIG. 7) is electrically connected to the control unit 100.

The recording unit 15 is a serial recording type recording unit that performs recording on the medium M while moving in a scanning direction. The recording device 11 is a textile printing machine composed of a serial printer in which the recording unit 15 is of a serial recording type. The medium M is a fabric (textile), a knitted fabric, a nonwoven fabric, or the like. The recording device 11 composed of the serial printer performs a single scanning by moving the recording unit 15 once in the scanning direction. The recording unit 15 performs a recording of one scanning (one path) in a single scanning. In other words, the recording device 11 performs a recording by alternately performing a recording operation of performing a recording for a single scanning by discharging droplets from the nozzles 18N during a single scanning of the recording unit 15, and a transport operation of transporting the medium M to the next recording position.

The plurality of rollers 31, 33 and 34 that guide the medium M unwound from the roll body R1 supported by the holding unit 12 along the transport path between the roll body R1 and the recording position where recording is performed by the recording unit 15 constitutes an example of the transport part. In other words, the rollers 31, 33 and 34 that constitute the wrinkle suppression device 13 constitute an example of the transport part together with the transport unit 16.

Specifically, in the recording device 11, the plurality of rollers 31, 33 and 34 that guides the medium M unwound from the first roll body R1 along the transport path is disposed at a portion between the roll body R1 held in the holding unit 12 and the transport unit 16. In this embodiment, all of the plurality of rollers 31, 33 and 34 are components of the wrinkle suppression device 13. Note that the plurality of rollers may include a roller other than the components of the wrinkle suppression device 13. For example, one or more other rollers may be provided at a portion on the transport path between the first roll body R1 and the wrinkle suppression device 13.

Here, of the plurality of rollers 31, 33 and 34, a roller around which the medium M fed from the first roll body R1 is wound first is set as the first roller. In this embodiment, of the two guide rollers 33 and 34 constituting the roller pair 32, the first guide roller 33 located upstream in the transport direction Y1 corresponds to an example of the first roller. The first guide roller 33 is located most upstream in the transport direction Y1 in the plurality of rollers 31, 33 and 34 constituting the wrinkle suppression device 13, and no other roller that guides the medium M is provided on the transport path between the first guide roller 33 and the roll body R1.

Note that, in the case of a configuration in which another roller is present, the roller located most upstream in the transport direction Y1 on the transport path among the rollers constitutes an example of the first roller. In addition, in the case of a configuration in which only one other roller is present, the one other roller corresponds to an example of the first roller. In this embodiment, a looseness forming operation of forming looseness in the medium M at the portion between the first roll body R1 and the first roller, and a pulling operation of pulling the medium M are alternately performed to apply a vibration to the medium M.

Figure 7:
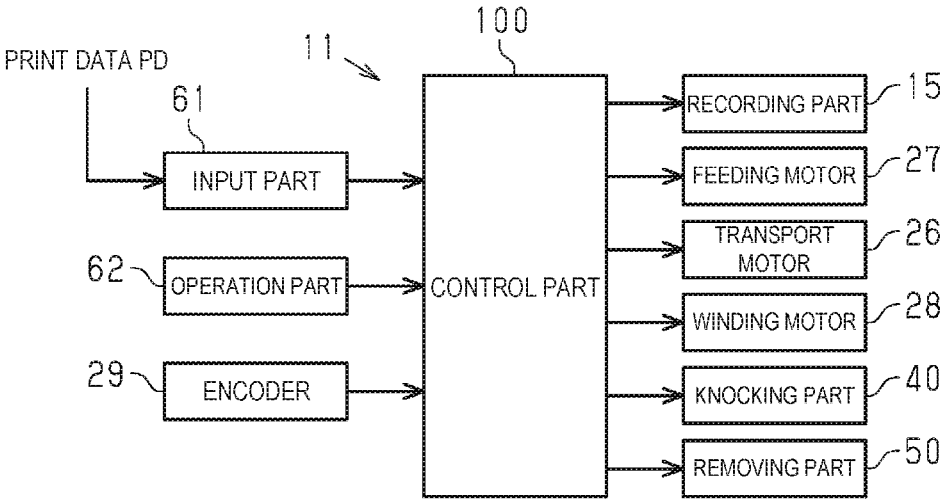
FIG. 7 is a block diagram illustrating an electrical configuration of the recording device.

The control unit 100 illustrated in FIG. 7 vibrates the medium M by controlling the feeding motor 27 such that a loosening force and a pulling force are alternately provided to the medium M at the portion between the roll body R1 and the first roller. The control unit 100 performs a vibration operation including one looseness forming operation and one pulling operation two or more times during a scanning period in which the recording unit 15 moves once in the scanning direction for recording on the medium M. Here, the looseness forming operation is an operation of forming looseness in the medium M at the portion between the roll body R1 and the first guide roller 33 by performing forward-driving of the feeding motor 27 in the forward rotation direction FR (see FIG. 8) in which the roll body R1 rotates forward so as to feed the medium M from the roll body R1. The pulling operation is an operation of applying a tension to the medium M at the portion between the roll body R1 and the first guide roller 33 by performing reverse-driving of the feeding motor 27 in a reverse direction BR (see FIG. 9) in which the roll body R1 is reversed so as to wind the medium M around the roll body R1. The medium M is vibrated by applying a tension to the medium M through a combination of the looseness forming operation and the pulling operation such that the medium M is once loosened and thereafter pulled to apply a tension to the medium M. Then, in this embodiment, the control unit 100 performs the vibration operation including one looseness forming operation and one pulling operation of the medium M two or more times during a single scanning period. In other words, the control unit 100 applies a vibration to the medium M two or more times during a single scanning period. By vibrating the medium M two or more times during a single scanning period, foreign substances adhered to the medium M are scattered.

In this embodiment, the control unit 100 performs a vibration application operation of vibrating the medium M two or more times for each scanning period. Here, the scanning period is a period in which a scanning operation for scanning is performed by the recording unit 15. The scanning period does not include a period in which a transport operation of transporting the medium M to the next recording position is performed. For example, the control unit 100 may perform a control of increasing the recording speed by performing the scanning operation and the transport operation at partially overlapping timings. In this case, the scanning period is the period in which the scanning operation is performed except for the period of the timing overlapping the transport operation. The control unit 100 does not perform the vibration operation in the transport period in which the transport operation is performed. Thus, a situation in which the transport operation is affected by the vibration operation is avoided. In this embodiment, during the transport operation period, a stable transport operation is achieved by actively feeding the medium M from the roll body R1 and adjusting the tension of the medium M during the transport. When the vibration application operation is performed during the transport operation, the control of feeding the medium M from the roll body R1 cannot be performed, and the medium M cannot be stably transported. In this case, the tension of the medium M during the transport may become unstable, and the accuracy of the transport position may be reduced. The reason for this is that the transport torque and the transport speed are controlled on the assumption that the tension of the medium M is within a predetermined assumed range. When the control unit 100 controls the feeding motor 27 to perform the vibration application operation and the original control of stabilizing the tension of the medium M being transported through the control of the feeding motor 27 is not performed, the tension of the medium M may fall outside the assumed range, and a risk of reduction in the accuracy of the transport position of the medium M may be posed. To avoid such a situation, the control unit 100 drives the feeding motor 27 during the scanning period to perform the vibration application operation.

Figure 8:
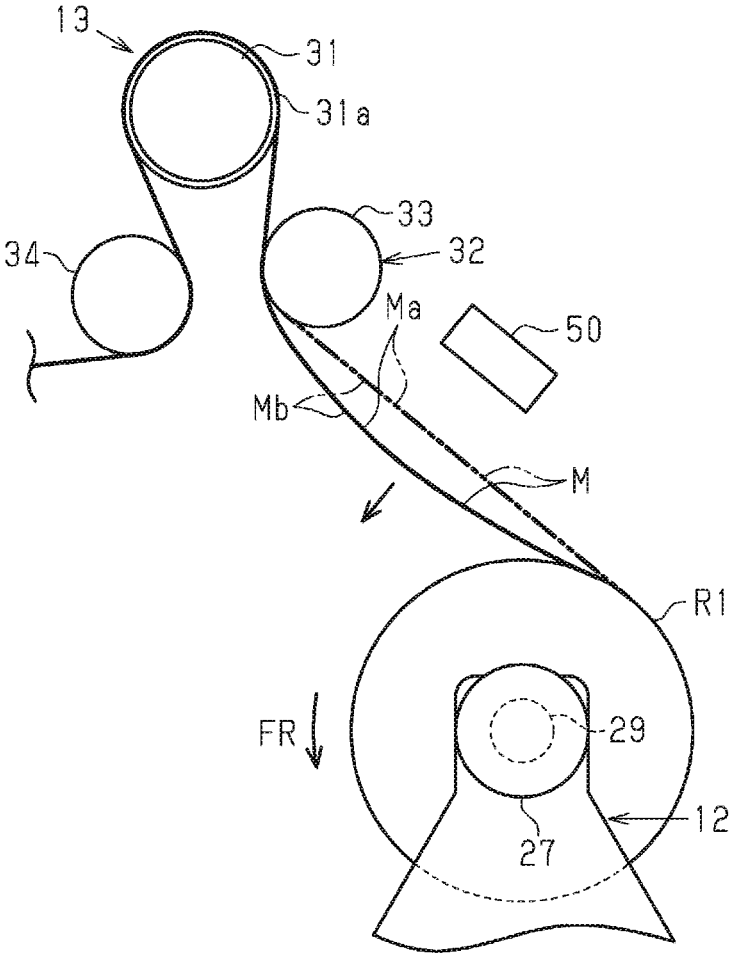
FIG. 8 is a schematic side view for describing a looseness forming operation of a vibration application mechanism according to a second embodiment.
Figure 9:
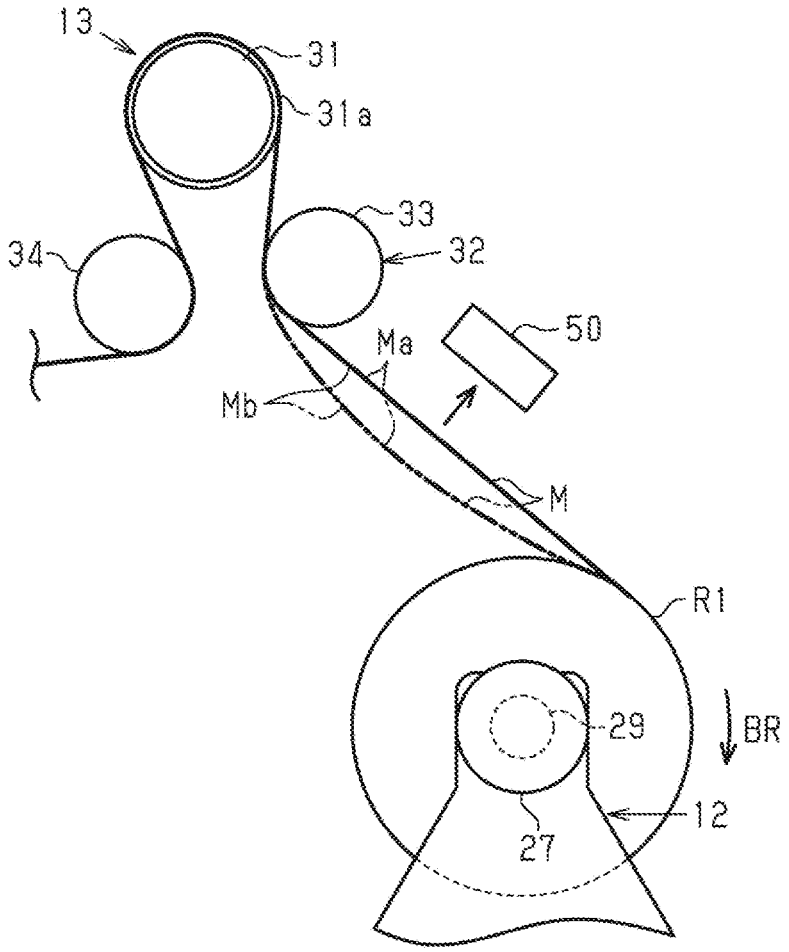
FIG. 9 is a schematic side view for describing a pulling operation of the vibration application mechanism.

In this embodiment, as illustrated in FIGS. 8 and 9, the removing unit 50 is provided at a position facing the first surface Ma at a portion where the medium M is vibrated. The removing unit 50 has a configuration similar to that of the first embodiment. Specifically, the removing unit 50 is composed of the blowing unit 50A or the suction part 50B. Here, the blowing unit 50A is disposed at a position downstream, in the transport direction Y1, of the position facing the central portion of the transport path of the medium M at the portion between the roll body R1 and the first guide roller 33, and the air flow may be blown upstream in the transport direction Y1 from the nozzle 53. In addition, the suction part 50B may be of the electrostatic suction type that suctions charged foreign substances using an electrostatic force, or the negative pressure suction type that suctions foreign substances by generating suction air flow using a negative pressure.

As illustrated in FIG. 7, the control unit 100 detects the amount of rotation and the rotational speed of the roll body R1 on the basis of the detection signal from the encoder 29. In addition, the control unit 100 calculates and acquires the current diameter of the roll body R1 on the basis of the initial diameter of the roll body R1 at the start of use, the thickness of the medium M, and the total length of the fed medium M after the start of use. The control unit 100 calculates the amount of rotation for the required forward rotation of the roll body R1 from the feeding amount required for forming looseness of a predetermined looseness amount in the medium M at the portion between the roll body R1 and the first guide roller 33. The control unit 100 drives the feeding motor 27 forward by the amount of rotation of the motor required for the forward rotation of the roll body R1 by the calculated amount of rotation. The control unit 100 counts the amount of rotation of the feeding motor 27 at this time on the basis of the detection signal of the encoder 29. When the amount of rotation counted on the basis of the detection signal of the encoder 29 reaches a target amount of rotation, the control unit 100 stops the forward-driving of the feeding motor 27. Through this control, the same amount of looseness can be formed in the medium M at all times at the portion between the roll body R1 and the first guide roller 33 regardless of the diameter of the roll body R1 at different times.

As illustrated in FIG. 8, through the looseness forming operation, looseness is formed as illustrated by the solid line in FIG. 8 in the medium M that has been located at the position illustrated by the chain double-dashed line at the portion between the roll body R1 and the first guide roller 33.

Next, as illustrated in FIG. 9, the control unit 100 performs a winding operation of winding the loose portion of the medium M as illustrated by the chain double-dashed line by performing a reverse-driving of the feeding motor 27. At this time, the control unit 100 winds the medium M around the roll body R1 until a predetermined tension is applied to the medium M at a portion between the roll body R1 and the first guide roller 33. The control unit 100 monitors the current value of the feeding motor 27, and stops the reverse-driving of the feeding motor 27 when the current value reaches a target current value for an application of a load corresponding to a target tension to be applied to the medium M. As a result, the target tension is applied to the medium M at the portion between the roll body R1 and the first guide roller 33.

Here, the target tension is set to a value that can apply a vibration capable of scattering foreign substances adhered to the medium M when the medium M in a loose state is pulled at the portion between the roll body R1 and the first guide roller 33. In addition, the target tension is set to a value that does not cause a positional shift due to the pulling of the medium M at a portion downstream of a location where a vibration is generated in the transport direction Y1. Thus, the positional shift of the medium M is suppressed at the portion of the recording position where the recording unit 15 performs recording on the medium M while scattering foreign substances such as fuzz adhered to the medium M from the first surface Ma of the medium M through the vibration.

In addition, the control unit 100 may acquire the medium type information about the type of the medium M, and may change the number of times of the vibration operations per scanning period in a range of two or more times in accordance with the type of the medium M identified based on the medium type information.

In addition, the recording device 11 may include the knocking unit 40 similar to that of the first embodiment. Specifically, the knocking unit 40 capable of knocking the second surface Mb of the medium M at the portion between the two rollers of the plurality of rollers 31, 33 and 34 constituting the transport part may be provided. In this case, the knocking unit 40 may include the cam 41 including the contact portion 41*a* capable of making contact with the second surface Mb, and the electric motor 44 as an example of the driving unit that rotates the cam 41.

The recording device 11 may also include the removing unit 50 similar to that of the first embodiment. Specifically, the removing unit 50 may be provided at a position that is opposite to the knocking unit 40 with the transport path of the medium M therebetween. In this case, the removing unit 50 may be the blowing unit 50A or the suction part 50B. In the case where the knocking unit 40 is provided, a vibration application operation in which the medium M at the portion between the roll body R1 and the first guide roller 33 is vibrated two or more times per scanning period, and a knocking operation in which the second surface Mb of the medium M at the portion between the first guide roller 33 and the tension roller 31 is knocked and vibrated with the knocking unit 40 are performed. Thus, by vibrating the medium M at two portions located at different positions in the transport direction Y1, foreign substances adhered to the first surface Ma of the medium M can be more effectively removed.

As described above, according to the second embodiment, the following effects are achieved.

(8) The recording device 11 includes the feeding motor 27 that rotates the roll body R1 supported by the holding unit 12 in a reverse direction, the recording unit 15 of the serial recording type, and the control unit 100 that controls the feeding motor 27. Of the plurality of rollers 31, 33 and 34 that guide the medium M along the transport path between the roll body R1 and the recording position of the recording unit 15, the roller 33 around which the medium M fed from the roll body R1 is wound first is set as the first roller. The control unit 100 performs, two or more times, the vibration operation including one loosening operation and one pulling operation during the scanning period in which the recording unit 15 moves once. Thus, by applying a vibration to the medium M through the loosening operation and the pulling operation of the medium M, foreign substances such as dust and fuzz can be scattered from the first surface Ma of the medium M. As a result, the scattering of foreign substances from the first surface Ma of the medium M can be further facilitated. The vibration operation including one loosening operation and one pulling operation of the medium M is performed during the scanning period, and therefore does not interfere with the transport operation of the medium M. In addition, since the vibration operation is performed two or more times per scanning period, a high foreign substance removal effect can be achieved. Thus, a high foreign substance removal effect for removing foreign substances from the medium is achieved, and there is no risk of damaging the recording surface of the medium.

In addition, when the removing unit 50 is provided, foreign substances that scatter from the first surface Ma of the medium M are removed by the removing unit 50, and thus the reattachment of the scattered foreign substances to the medium M can be suppressed. Further, when a configuration in which the knocking unit 40 knocks the second surface Mb of the medium M is adopted as in the first embodiment, an even higher foreign substance removal effect can be achieved.

Note that the above-described embodiments may be modified as the following modified examples. Further, the above-described embodiments and the modified examples described below may be further modified as appropriate as another modified example, or combinations of the following modified examples may be combined as appropriate as another modified example. Each of the modified examples described below may be applied regardless of the embodiments unless otherwise indicated.

Figure 10:
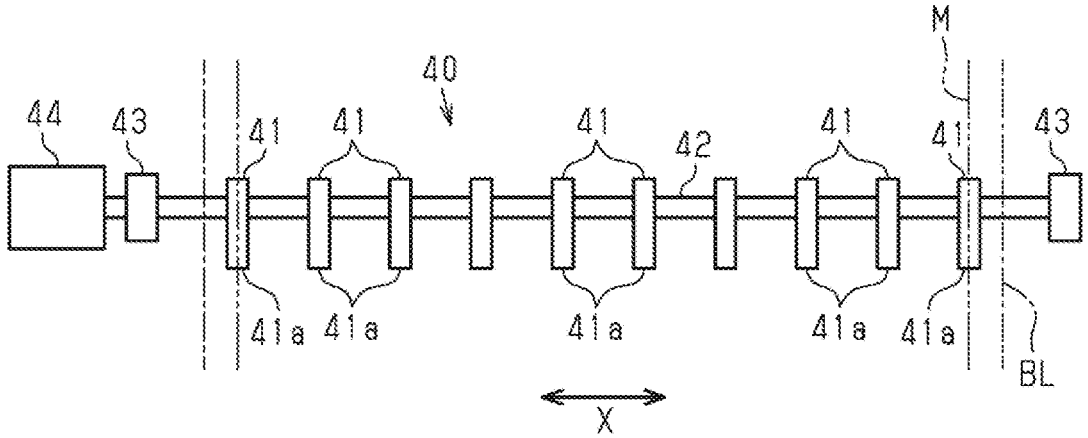
FIG. 10 is a front view illustrating a configuration of a knocking unit of a modified example.

As illustrated in FIG. 10, a plurality of the cams 41 may be provided to constitute the knocking unit 40 instead of the one cam 41. As illustrated in FIG. 10, the plurality of cams 41 are fixed to the rotation shaft 42 at a regular interval. The plurality of cams 41 are disposed in the same orientation and the contact portions 41*a* are located in the same direction at all times with respect to the center of the cam 41. That is, the plurality of cams 41 are fixed to the rotation shaft 42 in the same phase. The two cams 41 located at both ends in the width direction X are located outside the width region of the medium M. In other words, the arrangement length of the cams 41 in the width direction X is equal to or greater than the width of the medium M. Thus, when the electric motor 44 is driven, the plurality of cams 41 simultaneously knock the second surface Mb of the medium M over the entire width by the respective contact portions 41*a*. Note that the plurality of cams 41 may be fixed to the rotation shaft 42 in different phases. In this case, the second surface Mb of the medium M can be knocked at different timings by the plurality of cams 41. In the above-described configurations, the cam 41 can knock a plurality of portions of the medium M over the entire width, and thus the nonuniformity in the foreign substance removal effect in the width direction X of the medium M can be reduced.

Figure 11:
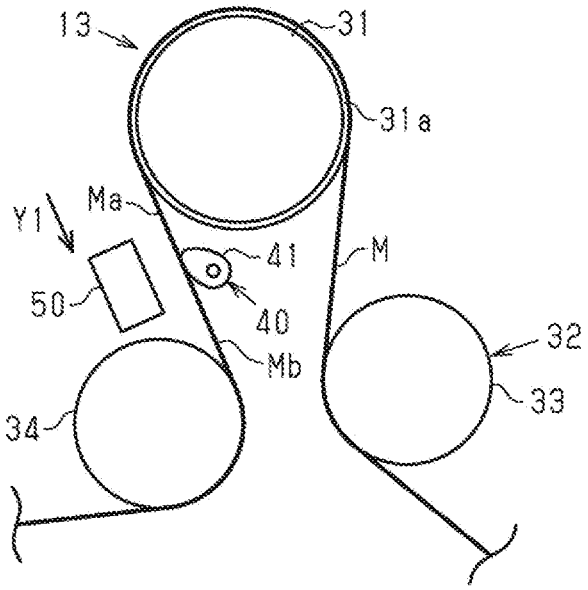
FIG. 11 is a schematic side view illustrating a knocking unit and a removing unit of a modified example.

As illustrated in FIG. 11, the knocking unit 40 may be provided at a position where the second surface Mb of the medium M at the portion between the tension roller 31 and the second guide roller 34 is knocked. With this configuration, the roller 34 is located downstream of the knocked portion on the transport path, and thus the propagation, to the downstream side, of the vibration of the knock of the knocking unit 40 on the second surface Mb can be suppressed.

Figure 12:
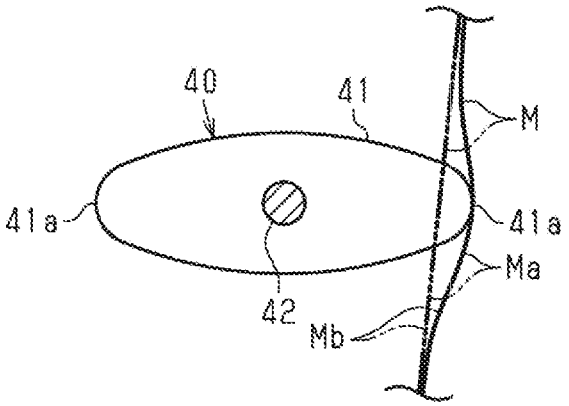
FIG. 12 is a schematic side view illustrating a cam of a modified example.
Figure 13:
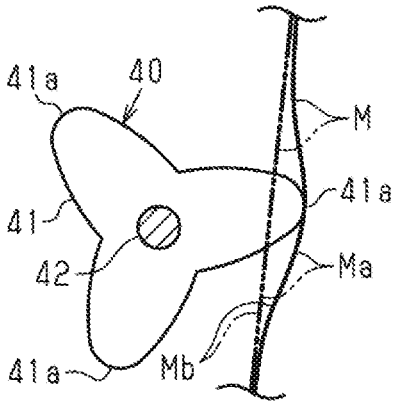
FIG. 13 is a schematic side view of a cam of a modified example different from that of FIG. 12.

The number of the contact portion 41*a* of the cam 41 is not limited to one. As illustrated in FIG. 12, the cam 41 may include two contact portions 41*a*. In this case, the two contact portions 41*a* sequentially knock the second surface Mb of the medium M during one rotation of the rotation shaft 42. In other words, the knocking unit 40 can knock twice per rotation of the cam 41. In addition, as illustrated in FIG. 13, the cam 41 may include three contact portions 41*a*. In this case, the three contact portions 41*a* sequentially knock the second surface Mb of the medium M during one rotation of the rotation shaft 42. In other words, the knocking unit 40 can knock three times per rotation of the cam 41. Further, the cam 41 may include four or more contact portions 41*a*. With the cam 41 including a plurality of contact portions 41*a* as described above, the knocking unit 40 can knock the second surface Mb of the medium M multiple times per rotation of the cam 41. With such configurations, the frequency of the knock on the second surface Mb of the medium M can be increased, and the foreign substance removal effect for the first surface Ma can be increased.

Figure 14:
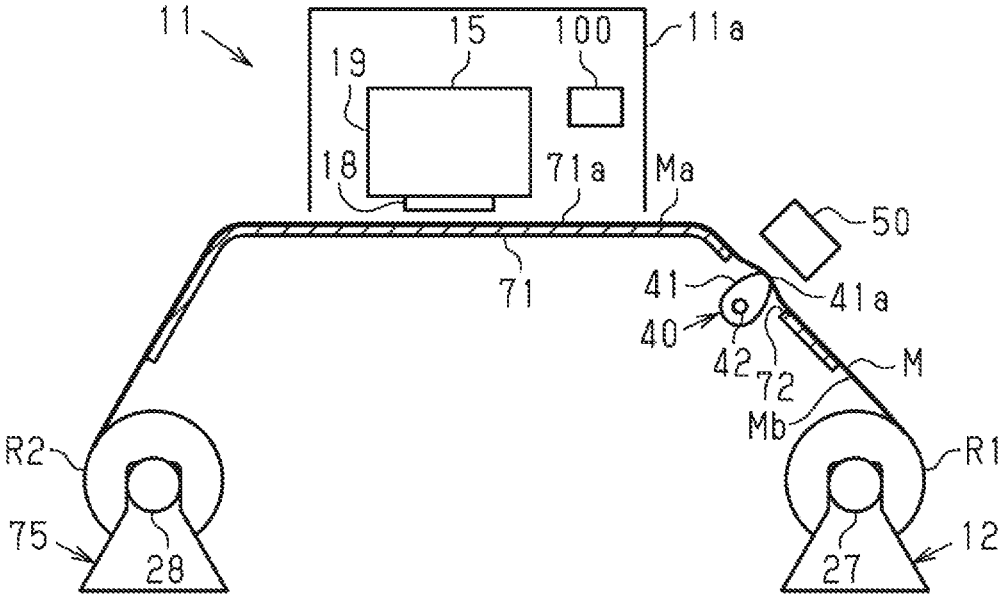
FIG. 14 is a schematic side cross-sectional view illustrating a recording device of a modified example.

As illustrated in FIG. 14, the recording device 11 may be of a roll-to-roll type. Specifically, a support 71 including a support surface 71*a* on which the medium M slides during the transport is provided. The holding unit 12 that holds the first roll body R1 and a winding part 75 that holds the second roll body R2 are provided on both sides of the support 71. The holding unit 12 includes the feeding motor 27. In addition, the winding part 75 includes the winding motor 28. The medium M fed from the first roll body R1 is transported such that the medium M slides on the support surface 71*a* of the support 71, and, after recording is performed at the recording unit 15, the medium M is wound around the second roll body R2. The support 71 includes an opening 72 at a portion upstream of the recording unit 15 in the transport direction. The knocking unit 40 is disposed at a position corresponding to the opening 72 on the rear surface side of the support 71. The knocking unit 40 includes the cam 41, the rotation shaft 42 on which the cam 41 is fixed, and the electric motor 44 (see FIGS. 3 and 10) that rotates the rotation shaft 42. The cam 41 is exposed from the opening 72. As the cam 41 rotates, the contact portion 41*a* protrudes from the opening 72 to knock the second surface Mb of the medium M sliding on the support surface 71*a* of the support 71. When a portion other than the contact portion 41*a* of the cam 41 faces the opening 72, the contact portion 41*a* is separated from the second surface Mb of the medium M. The knocking unit 40 knocks the second surface Mb by moving between the spaced position for being spaced apart from the second surface Mb and the contact position for making contact with the second surface Mb. Even with the recording device 11 of the roll-to-roll type, foreign substances adhered to the first surface Ma of the medium M can be removed by scattering them through vibration. In addition, by disposing the removing unit 50 on the side opposite the knocking unit 40 with the transport path of the medium M therebetween, the foreign substances scattered from the first surface Ma of the medium M can be removed. Thus, the reattachment of foreign substances scattered from the first surface Ma to the first surface Ma due to vibration can be suppressed.

In the first embodiment, the feeding motor 27 and the winding motor 28 may be controlled by the control unit 100. In this case, the feeding motor 27 is driven in synchronization with the transport motor 26 serving as the drive source of the transport belt 21, and is rotationally controlled by the control unit 100 such that excessive tension is not applied to the medium M and that occurrence of looseness is prevented. In addition, the control unit 100 controls the winding motor 28 to control the peeling operation of winding the roll body R2 held in the peeling device 14. In addition, in the second embodiment, the winding motor 28 may be controlled by the control unit 100.

The transport part is not limited to the glue belt serving as the transport belt 21 including the adhesive layer 25, and the method of attaching the medium M to the transport belt 21 may be an electrostatic attaching method using an electrostatic force to attach the medium M to the support surface 21*a* of the transport belt 21, or a negative pressure suction method for the medium M other than mediums having high air permeability such as a fabric.

The reciprocation of the knocking unit between the spaced position and the contact position may be performed once.

The reciprocation of the knocking unit between the spaced position and the contact position is not limited to a continuous movement with the rotation of the cam 41. It is possible to adopt a reciprocation in which the knocking unit reciprocates from the spaced position to the contact position, or a reciprocation in which the knocking unit reciprocates from the contact position to the spaced position.

Preferably, the movement of the knocking unit between the spaced position and the contact position is a reciprocation, but the movement is not limited to a reciprocation. The movement may be a movement of the knocking unit from the spaced position to the contact position. In addition, the movement may be a movement of the knocking unit from the contact position to the spaced position. Such movements in one direction can also hit a medium stretched under tension. Note that in the case where the medium is knocked at a portion where no tension is applied, the movement of the knocking unit from the spaced position to the contact position is preferable.

The knocking unit 40 is not limited to the configuration using a rotational motion of the cam 41, and it is possible to adopt a configuration using a linear motion of a solenoid actuator.

In the case where the removing unit 50 is the suction part 50B, foreign substances may be suctioned from an end edge of the medium M in the width direction X.

A double sided recording may be performed. In the case where a double-sided recording is performed, a knock on the second surface before the recording to the first surface may increase the fuzz of the second surface. In a double-sided recording, the medium M is reversed such that the second surface becomes a second surface serving as the next recording surface, and the recorded first surface becomes the next second surface. In this case, the second surface that is the surface having been subjected to the recording is knocked; however, since the knock merely hits the medium M, the recorded surface is less damaged in comparison with a configuration in which the medium M is scratched with a brush. Thus, the recorded second surface can be knocked, and, during recording on either surface in a double-sided recording, a knock on the second surface can remove foreign substances from the first surface serving as the recording surface.

In the second embodiment, the vibration application operation of performing two or more vibration operations during a single scanning period may not be performed for each scanning period. For example, the operation may be performed every other scanning period, or every two or more scanning periods. In addition, it is possible to adopt a configuration in which whether to perform the vibration operation in the scanning period of the current scanning operation is determined in accordance with the transport amount of the medium M of the next transport operation such that the vibration operation is performed two or more times in the current scanning period when it is determined that the vibration operation should be performed. The control unit 100 makes the determination to satisfy the above-described condition from the transport amount of the next transport operation in the determination.

It is possible to provide a retraction mechanism that retracts at least one of the knocking unit 40 and the removing unit 50 from a position near the transport path during use. In this case, the ease of the setting operation of the medium M is increased.

The gas blown by the blowing unit 50A may not be air. In this case, gas with low reactivity, such as nitrogen gas and noble gas, is preferable. For example, a cylinder filled with gas is connected to an intake chamber of the blowing unit 50A, and the gas supplied from the cylinder is blown by a fan from a nozzle. Note that, in the case where the first surface Ma of the medium M is modified before the recording is performed, a reactive gas for modifying the first surface Ma of the medium M may be an example of the gas.

In the case where the transport part is of a transport belt type that transports the medium M by the transport belt 21, the method of bring the medium M into intimate contact with the support surface 21*a* is not limited to the configuration in which the transport belt 21 is the glue belt including the adhesive layer 25. It is possible to adopt an electrostatic suction type using an electrostatic force to attach the medium M to the support surface 21*a* of the transport belt 21, or a negative pressure suction type using a negative pressure to attach the medium M to the support surface 21*a* of the transport belt 21.

In the second embodiment, the recording device 11 may be of a roll-to-roll type. For example, in the recording device 11 illustrated in FIG. 14, the transport part transports the medium M by winding around the second roll body R2 the medium M fed from the first roll body R1 while sliding the medium M along the support surface 71*a* of the support 71 between the first roll body R1 configured for feeding and the second roll body R2 configured for winding, which are held on both sides of the support 71. The recording unit 15 performs recording on a portion of the medium M on the support surface 71*a* of the support 71. The recording device 11 may include a roller that constitutes a transport part, and may be configured to perform, two or more times, a vibration application operation including one looseness forming operation of forming looseness in the medium M at a portion between the roll body R1 and the first roller located most upstream in the transport direction, and one pulling operation of applying a tension to the medium M at that portion. In addition, for example, as in the first embodiment, the wrinkle suppression device 13 may be provided, and the vibration application operation may be performed with the roller located most upstream in the transport direction Y1 set as the first roller among the plurality of rollers constituting the wrinkle suppression device 13.

The knocking unit may be a vibration motor. It is possible to adopt a configuration in which the medium M is periodically vibrated by the vibration motor. The vibration motor includes a vibrator that makes contact with the medium M to apply a vibration. The amplitude of the vibrator is a microscopic value, and the vibrator vibrates by moving between a spaced position for being spaced apart from the second surface Mb and a contact position for making contact with the second surface Mb. In this case, the removing unit 50 may be provided at a position that is opposite to the vibration motor with the transport path therebetween.

The driving unit of the knocking unit 40 is not limited to the electric motor 44, and may be a solenoid plunger or a linear motor. With such a driving unit, the medium M may be vibrated by knocking the second surface of the medium M through a linear reciprocation of the contact portion of the knocking unit.

The transport part may have a configuration in which a support member such as a platen is disposed instead of the transport belt 21 at a position facing the recording unit 15, and the medium M is transported by the transport roller pair.

The recording device 11 is not limited to a textile printing machine that performs recording on a fabric, and may be a recording device that performs recording on a roll sheet. With this configuration, foreign substances such as paper powder can be removed.

The recording device 11 is not limited to a serial printer in which the recording unit 15 reciprocates in the scanning direction X or a line printer in which the recording unit 15 extends in the width direction, and the recording unit 15 may be a lateral printer capable of moving in two directions of a main scanning direction and a secondary scanning direction.

The recording device 11 is not limited to an ink-jet type, and may be of a wire impact type or a heat-transfer type. In addition, the recording device 11 may be of an electrophotographic type that fixes an image or the like to the medium M by various photosensitive means after a solid toner is applied.

The recording device 11 may be a multifunction machine equipped with a reading unit.

The medium M of the roll body R1 is not limited to a fabric, and may be a roll sheet, a flexible plastic film, a nonwoven fabric, a knitted material, or the like, or may be a rolled laminate film or a metal foil.

The recording device is not limited to a printer configured for recording. For example, it may be a device that discharges a liquid material in which particles of a functional material are dispersed or mixed in a liquid to record and produce electrical wiring patterns or pixels of various displays such as liquid crystal displays, electroluminescence (EL) displays, and surface-emission displays, on a substrate as an example of the medium.

Hereinafter, technical concepts and operational effects thereof that are understood from the above-described embodiments and modified examples are described.

A recording device includes a recording unit configured to perform recording on a first surface of a medium, a holding unit configured to hold a roll body obtained by rolling the medium, a transport part configured to transport the medium unwound from the roll body, and a knocking unit configured to knock a second surface of the medium between the holding unit and the recording unit, the second surface being a surface opposite the first surface. The knocking unit knocks the second surface by moving between a spaced position for being spaced apart from the second surface and a contact position for making contact with the second surface.

With this configuration, the vibration generated by the impact of the knock of the knocking unit on the second surface of the medium scatters the adhered foreign substances from the first surface of the medium. In this manner, the foreign substances can be removed from the medium. Thus, a foreign substance removal effect higher than using only air blow can be achieved.

The recording device may include a removing unit configured to remove a foreign substance from the first surface, the removing unit being disposed at a position on an opposite side of a path of the medium from the knocking unit.

With this configuration, the foreign substances that scatter from the medium knocked by the knocking unit can be removed by the removing unit. Thus, the reattachment of the foreign substances to the medium can be suppressed.

In the recording device, the removing unit may be a blowing unit configured to blow gas to the first surface of the medium, and may be provided at a position downstream of the knocking unit in a transport direction of the medium.

With this configuration, the foreign substances that scatter from the medium knocked by the knocking unit can be removed by the gas flow blown from the blowing unit. Thus, the reattachment of the foreign substances to the medium can be suppressed. In addition, the gas flow is blown upstream from a position downstream of the knocking unit in the transport direction of the medium. Thus, the foreign substances can be prevented from flowing to the recording unit located downstream in the transport direction.

The recording device may include a tension bar configured to make contact with the second surface of the medium at a portion between the holding unit and the recording unit, and a roller pair configured to wind the medium around the tension bar by pushing the first surface at a portion upstream of a portion wound around the tension bar and at a portion downstream of the portion wound around the tension bar. The knocking unit may be configured to knock the medium at a portion between one roller of the roller pair and the tension bar.

With this configuration, the medium is knocked at a portion to which a tension is applied between one roller of the roller pair and the tension bar. In addition, the path of the medium at the portion between one roller of the roller pair and the tension bar is not changed by the change of the diameter of the roll body, and therefore a situation in which the second surface cannot be appropriately knocked due to a change of the path of the medium can be avoided. Thus, a high foreign substance removal effect can be achieved since the second surface of the medium can be properly knocked and an appropriate vibration can be applied to the medium.

In the recording device, the knocking unit may include a cam including a contact portion configured to make contact with the second surface, and a driving unit configured to rotate the cam. With the above-described configuration, the knocking unit with a simple configuration can be achieved.

In the recording device, an arrangement length of the cam may be equal to or greater than a width of the medium in a width direction, the width direction being a direction that intersects a transport direction of the medium and is parallel to a support surface where the transport part supports the medium.

With this configuration, the cum can knock the medium over the range of the entire width at a time or at a plurality of locations, and thus the nonuniformity in the foreign substance removal effect in the width direction of the medium can be reduced. In other words, a high foreign substance removal effect is achieved over the entire range in the width direction of the medium.

The recording device may include a control unit configured to control the driving unit. The control unit may acquire medium type information about a type of the medium and change a rotational speed of the cam in accordance with the type of the medium identified based on the medium type information.

With this configuration, since the rotational speed of the cam is changed in accordance with the type of the medium, the foreign substance scattering capability can be optimized in accordance with the type of the medium. For example, the rotational speed of the cam is increased in the case where the medium is less torn and foreign substance is difficult to remove, whereas the speed of rotation is reduced in the case of a medium that is easily torn. Here, examples of the medium that less scatters foreign substances include a fabric (textile), a knitted fabric, and a nonwoven fabric that are long-pile and tend to contain foreign substances therein.

The recording device may include a drive source configured to rotate the roll body supported by the holding unit in forward and reverse directions, and a control unit configured to control the drive source. The recording unit may be a serial recording type recording unit that performs recording on the medium while moving in a scanning direction, the transport part may include a plurality of rollers configured to guide the medium unwound from the roll body supported by the holding unit along a transport path between the roll body and a recording position where recording is performed by the recording unit, and when, of the plurality of rollers, a roller around which a medium fed from the roll body is wound first is set as a first roller, the control unit may perform a vibration operation including one loosening operation and one pulling operation twice during a scanning period in which the recording unit moves once in a scanning direction for recording on the medium, the loosening operation being an operation of forming looseness in the medium at a portion between the roll body and the first roller by feeding the medium from the roll body by driving the drive source in a direction for rotating the roll body forward, the pulling operation being an operation of applying a tension to the medium by pulling a lose portion of the medium between the roll body and the first roller by driving the drive source in a direction in which the roll body is reversed to wind the medium around the roll body.

With this configuration, foreign substances such as dust and fuzz can be scattered from the first surface of the medium by the knock of the knocking unit on the second surface of the medium, and by applying a vibration to the medium through the loosening operation and the pulling operation of the medium. Thus, scattering of foreign substances such as dust from the first surface of the medium can be further facilitated. In addition, the vibration operation including one loosening operation and one pulling operation for the medium is performed during the scanning period in which the recording unit moves once in the scanning direction for the recording to the medium, and therefore does not interfere with the transport operation of the medium. Further, the vibration operation is performed two or more times per scanning period, and thus a high foreign substance removal effect can be achieved.

What is claimed is:

1. A recording device comprising:

a recording unit configured to perform recording on a first surface of a medium;

a holding unit configured to hold a roll body obtained by rolling the medium;

a transport part configured to transport the medium unwound from the roll body; and a knocking unit configured to knock on a second surface of the medium between the holding unit and the recording unit, the second surface being a surface opposite the first surface, wherein the knocking unit knocks on the second surface by moving between a spaced position for being spaced apart from the second surface and a contact position for making contact with the second surface, and the knocking unit comprises:

a rotation shaft configured to rotate; and a cam coupled to the rotation shaft and configured to rotate with the rotation shaft causing the knocking unit to move between the spaced position and the contact position.

2. The recording device according to claim 1, comprising a removing unit configured to remove a foreign substance from the first surface, the removing unit being disposed at a position on an opposite side of a path of the medium from the knocking unit.

3. The recording device according to claim 2, wherein the removing unit is a blowing unit configured to blow gas to the first surface of the medium, and is provided at a position downstream of the knocking unit in a transport direction of the medium.

4. The recording device according to claim 1, comprising:

a tension bar configured to make contact with the second surface of the medium at a portion between the holding unit and the recording unit; and a roller pair configured to wind the medium around the tension bar by pushing the first surface at a portion upstream of a portion wound around the tension bar and at a portion downstream of the portion wound around the tension bar, wherein the knocking unit provided is configured to knock on the medium at a portion between one roller of the roller pair and the tension bar.

5. The recording device according to claim 1, wherein the knocking unit includes a driving unit configured to rotate the cam.

6. The recording device according to claim 5, wherein an arrangement length of the cam is equal to or greater than a width of the medium in a width direction, the width direction being a direction that intersects a transport direction of the medium and is parallel to a support surface where the transport part supports the medium.

7. The recording device according to claim 5, comprising a control unit configured to control the driving unit, wherein the control unit acquires medium type information about a type of the medium and changes a rotational speed of the cam in accordance with the type of the medium identified based on the medium type information.

8. A recording device, comprising:

a recording unit configured to perform recording on a first surface of a medium;

a holding unit configured to hold a roll body obtained by rolling the medium;

a transport part configured to transport the medium unwound from the roll body;

a knocking unit configured to knock on a second surface of the medium between the holding unit and the recording unit, the second surface being a surface opposite the first surface; and a drive source configured to rotate the roll body supported by the holding unit in forward and reverse directions; and a control unit configured to control the drive source, wherein the knocking unit knocks on the second surface by moving between a spaced position for being spaced apart from the second surface and a contact position for making contact with the second surface, the recording unit performs recording on the medium while moving in a scanning direction, the transport part includes a plurality of rollers configured to guide the medium, unwound from the roll body supported by the holding unit, along a transport path between the roll body and a recording position where recording is performed by the recording unit, and when a roller, among the plurality of rollers, around which a medium fed from the roll body is wound first is a first roller, the control unit performs a vibration operation twice or more during a scanning period in which the recording unit moves once in a scanning direction for recording on the medium, the vibration operation including one loosening operation and one pulling operation, the loosening operation being an operation of forming looseness in the medium at a portion between the roll body and the first roller by feeding the medium from the roll body by driving the drive source in a direction for rotating the roll body forward, the pulling operation being an operation of applying a tension to the medium by pulling a lose portion of the medium between the roll body and the first roller by winding the medium around the roll body by driving the drive source in a direction for reversing the roll body.

* * * * *